US011305553B2

(12) United States Patent
Nishimura

(10) Patent No.: US 11,305,553 B2
(45) Date of Patent: Apr. 19, 2022

(54) THERMAL PRINT HEAD AND METHOD OF MANUFACTURING THERMAL PRINT HEAD

(71) Applicant: ROHM CO., LTD., Kyoto (JP)

(72) Inventor: Isamu Nishimura, Kyoto (JP)

(73) Assignee: ROHM Co., Ltd., Kyoto (JP)

( * ) Notice: Subject to any disclaimer, the term of this patent is extended or adjusted under 35 U.S.C. 154(b) by 0 days.

(21) Appl. No.: 16/899,059

(22) Filed: Jun. 11, 2020

(65) Prior Publication Data

US 2020/0391517 A1 Dec. 17, 2020

(30) Foreign Application Priority Data

Jun. 14, 2019 (JP) ..... JP2019-111099

(51) Int. Cl.
*B41J 2/335* (2006.01)

(52) U.S. Cl.
CPC ..... *B41J 2/33515* (2013.01); *B41J 2/3353* (2013.01); *B41J 2/3358* (2013.01); *B41J 2/3359* (2013.01); *B41J 2/33585* (2013.01); *B41J 2/3354* (2013.01); *B41J 2/3357* (2013.01)

(58) Field of Classification Search
CPC .. B41J 2/33515; B41J 2/33585; B41J 2/3358; B41J 2/3353; B41J 2/3359; B41J 2/3354; B41J 2/3357
See application file for complete search history.

(56) References Cited

U.S. PATENT DOCUMENTS 5,949,465 A * 9/1999 Taniguchi ..... B41J 2/3355 347/205
2002/0158959 A1* 10/2002 Shirakawa ..... B41J 2/3353 347/202
2009/0201355 A1* 8/2009 Koyama ..... B41J 2/33525 347/203

FOREIGN PATENT DOCUMENTS

JP 2017-065021 A 4/2017
JP 2017114050 A * 6/2017 ..... B41J 2/335

* cited by examiner

*Primary Examiner* — Yaovi M Ameh
(74) *Attorney, Agent, or Firm* — Hamre, Schumann, Mueller & Larson, P.C.

(57) ABSTRACT

A thermal print head includes: a substrate; a resistor layer supported by the substrate and including a plurality of heat generating portions arranged in a main scanning direction; a wiring layer supported by the substrate and forming an energizing path to the plurality of heat generating portions; and an insulating layer interposed between the substrate and the resistor layer, wherein the substrate has a cavity portion overlapping the plurality of heat generating portions when viewed in a thickness direction of the substrate.

16 Claims, 23 Drawing Sheets

THERMAL PRINT HEAD AND METHOD OF MANUFACTURING THERMAL PRINT HEAD

CROSS-REFERENCE TO RELATED APPLICATION

This application is based upon and claims the benefit of priority from Japanese Patent Application No. 2019-111099, filed on Jun. 14, 2019, the entire contents of which are incorporated herein by reference.

TECHNICAL FIELD

The present disclosure relates to a thermal print head and a method of manufacturing the thermal print head.

BACKGROUND

In the related art, an example of a thermal print head is disclosed. The thermal print head in the related art includes a first substrate on which a wiring layer and a resistor layer are formed, and a second substrate on which a driver IC is mounted. The resistor layer has a plurality of heat generating portions arranged in a main scanning direction.

In printing with the thermal print head, the heat generating portions of the resistor layer generate heat when energized. The transfer of this heat causes a printing paper to develop color, and the paper is printed.

SUMMARY

Some embodiments of the present disclosure provide a thermal print head capable of improving print quality and a method for manufacturing the thermal print head.

According to one embodiment of the present disclosure, there is provided a thermal print head including: a substrate; a resistor layer supported by the substrate and including a plurality of heat generating portions arranged in a main scanning direction; a wiring layer supported by the substrate and forming an energizing path to the plurality of heat generating portions; and an insulating layer interposed between the substrate and the resistor layer, wherein the substrate has a cavity portion overlapping the plurality of heat generating portions when viewed in a thickness direction of the substrate.

Other features and advantages of the present disclosure will become more apparent from the detailed description given below with reference to the accompanying drawings.

DETAILED DESCRIPTION

Figure 1:
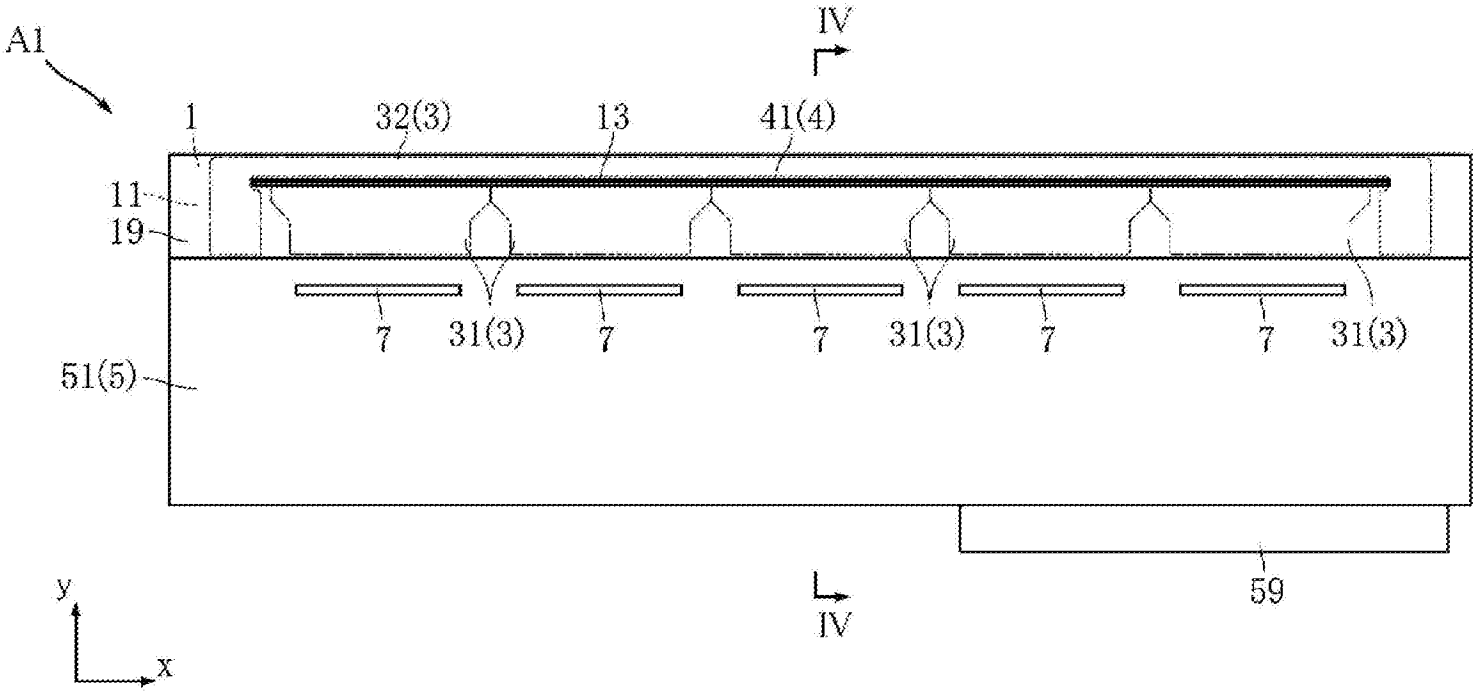
FIG. 1 is a plan view showing a thermal print head according to a first embodiment of the present disclosure.

Some embodiments of the present disclosure will be now described in detail with reference to the drawings.

In the present disclosure, terminologies such as "first," "second," "third" and the like are used simply as labels and are not necessarily intended to give a permutation to those objects.

First Embodiment

FIGS. 1 to 6 show a thermal print head according to a first embodiment of the present disclosure. The thermal print head A1 of the present embodiment includes a first substrate 1, an insulating layer 19, a protective layer 2, a wiring layer 3, a resistor layer 4, a second substrate 5, a driver IC 7 and a heat radiating member 8. The thermal print head A1 is incorporated in a printer that prints on a print medium (not shown), which is conveyed while being sandwiched between a platen roller 91 and the thermal print head A1. An example of such a print medium may include a thermal paper for producing a barcode sheet or a receipt.

Figure 2:
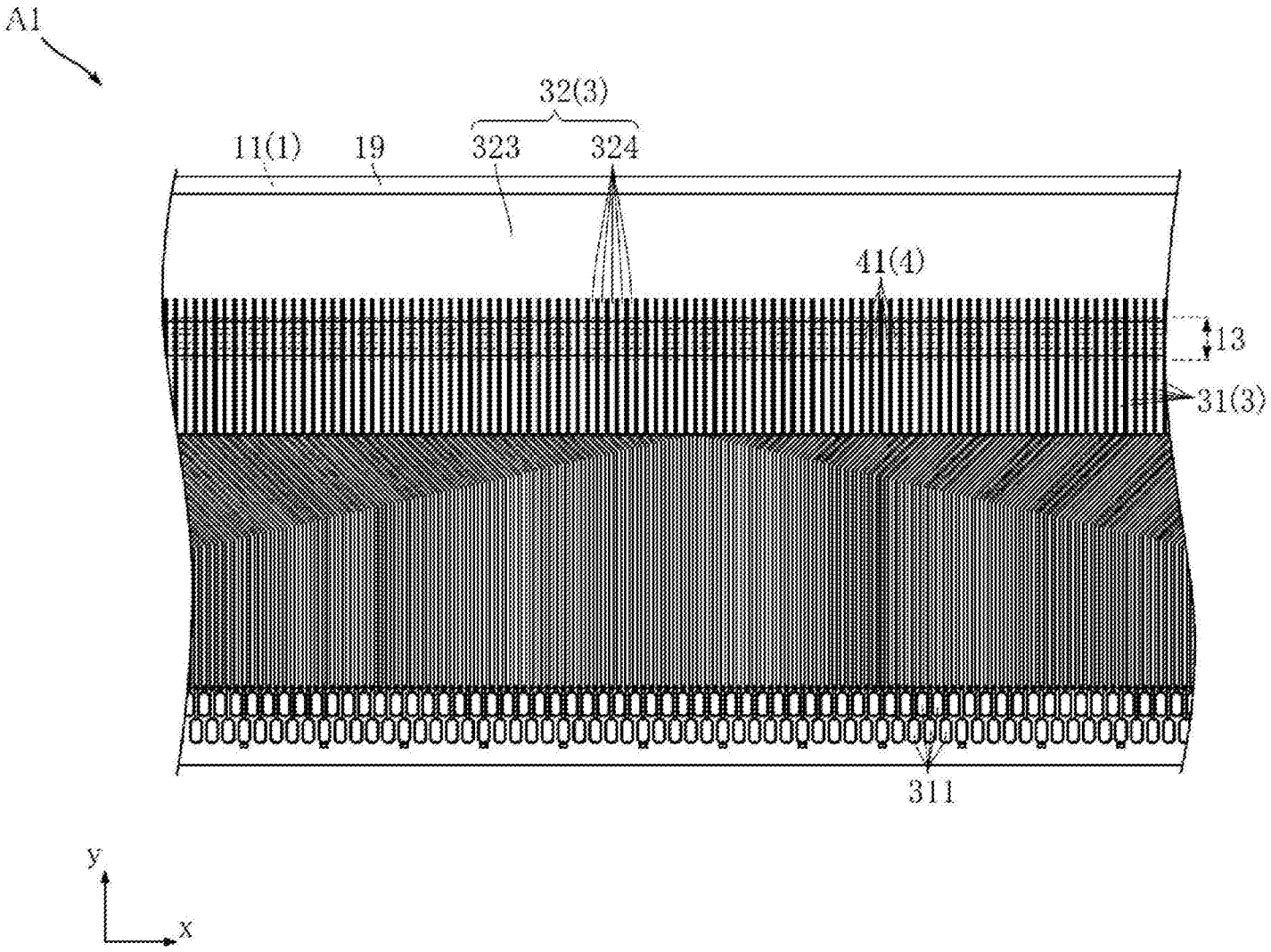
FIG. 2 is a main part plan view showing the thermal print head according to the first embodiment of the present disclosure.
Figure 3:
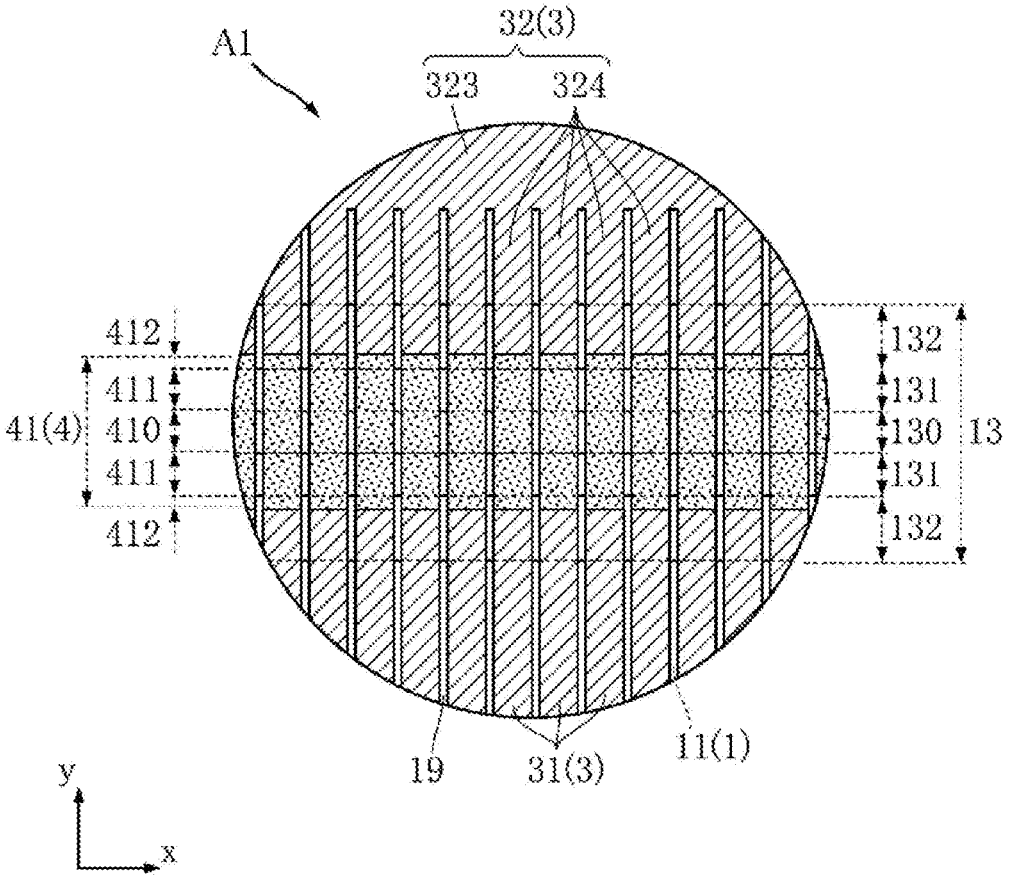
FIG. 3 is an enlarged main part plan view showing the thermal print head according to the first embodiment of the present disclosure.
Figure 4:
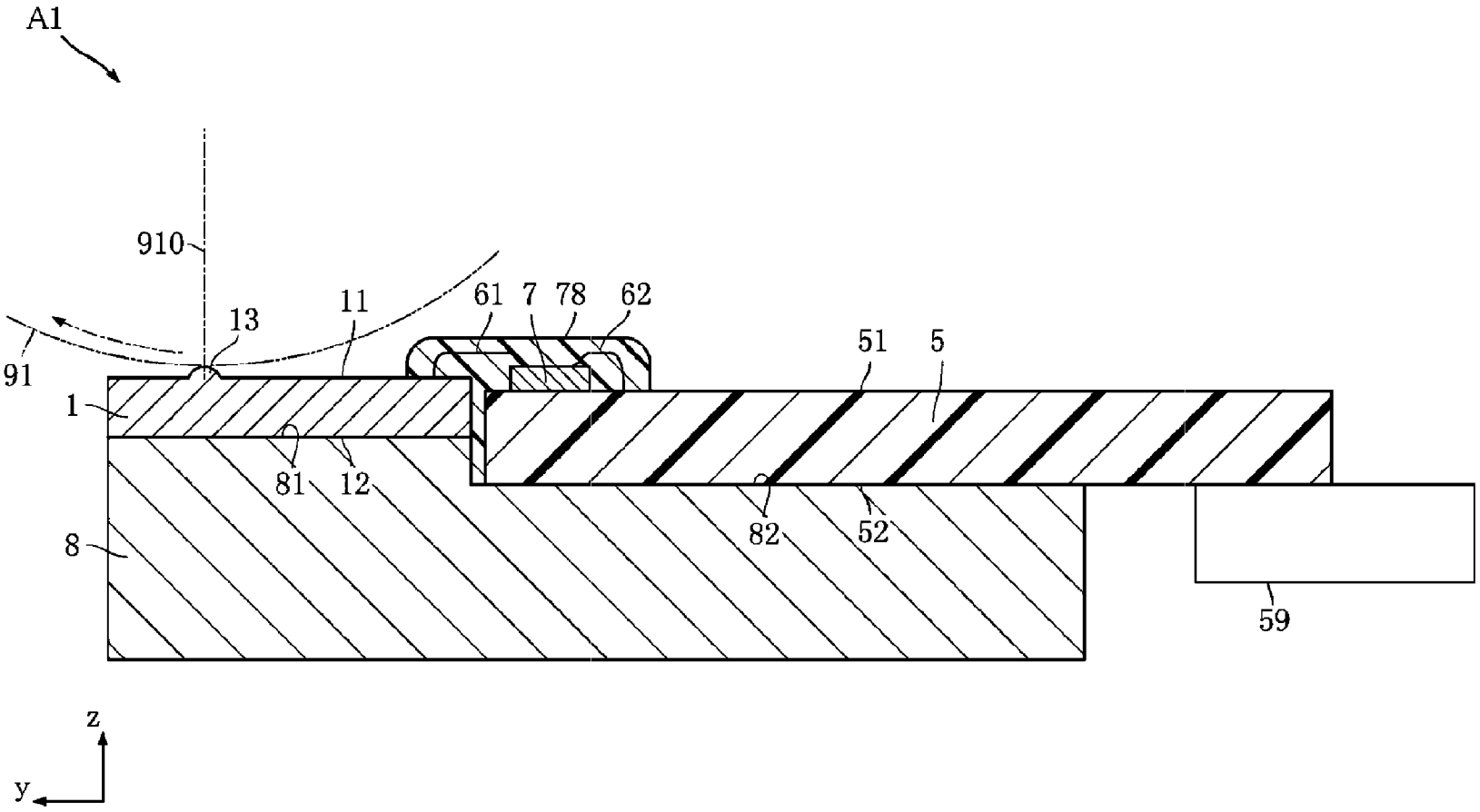
FIG. 4 is a cross-sectional view taken along line IV-IV of FIG. 1.
Figure 5:
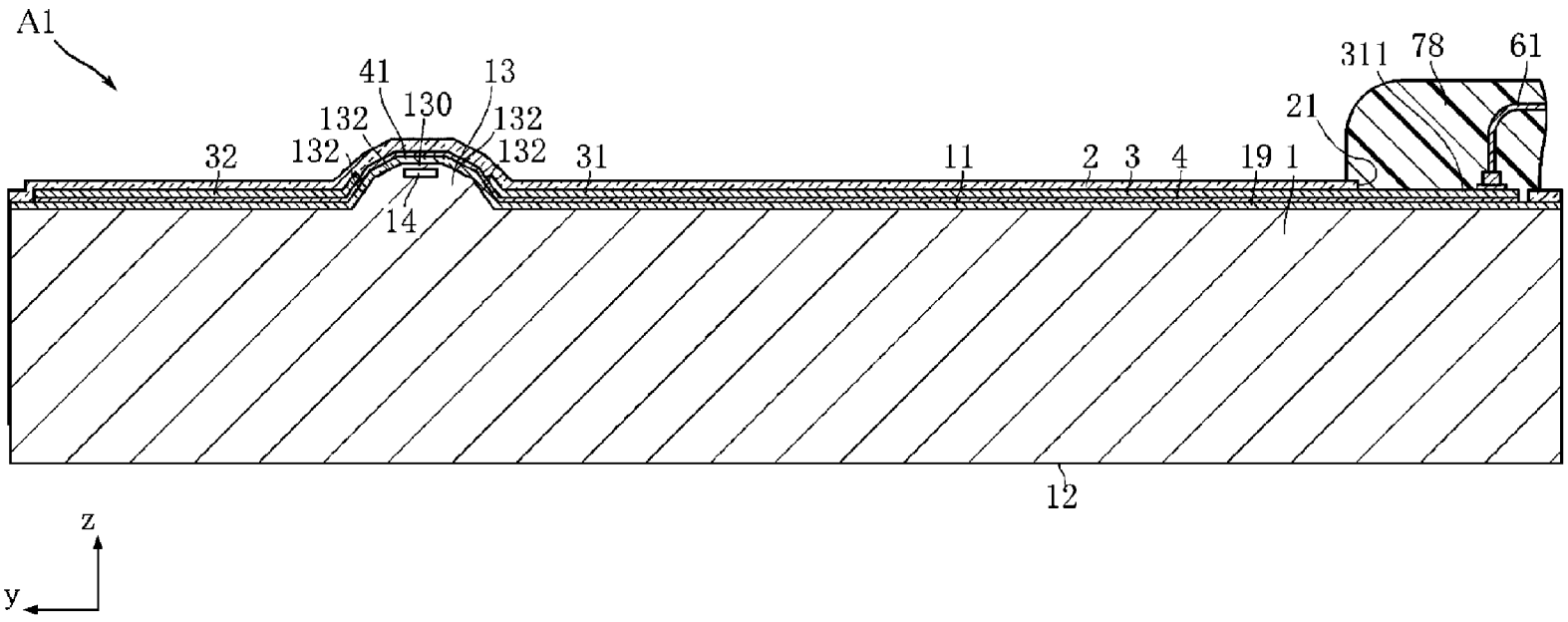
FIG. 5 is a main part cross-sectional view showing the thermal print head according to the first embodiment of the present disclosure.
Figure 6:
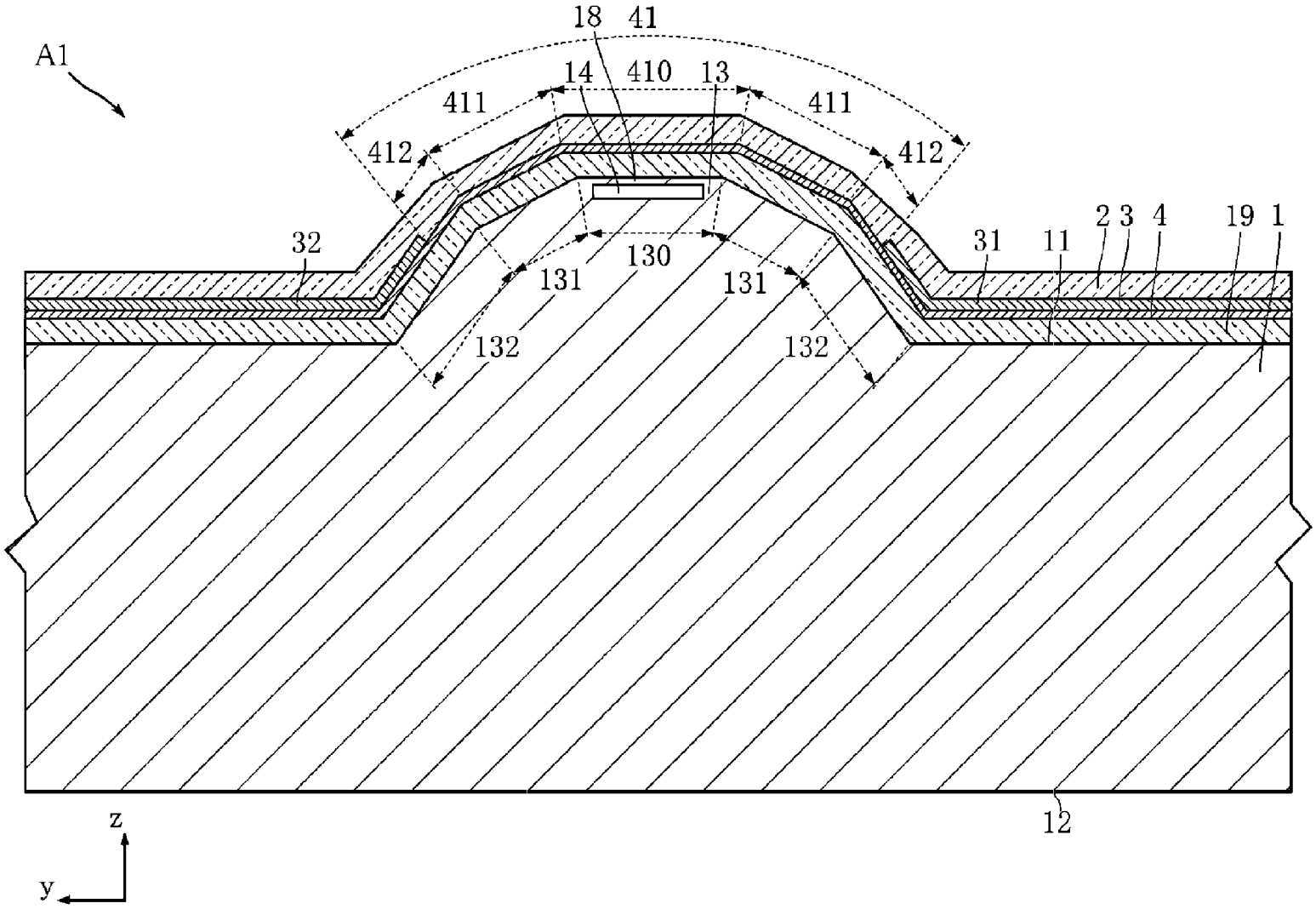
FIG. 6 is an enlarged main part cross-sectional view showing the thermal print head according to the first embodiment of the present disclosure.

FIG. 1 is a plan view illustrating the thermal print head A1. FIG. 2 is a plan view illustrating a main part of the thermal print head A1. FIG. 3 is an enlarged plan view illustrating the main part of the thermal print head A1. FIG. 4 is a cross-sectional view taken along line IV-IV in FIG. 1. FIG. 5 is a cross-sectional view of the main part illustrating the thermal print head A1. FIG. 6 is an enlarged cross-sectional view of the main part illustrating the thermal print head A1. For convenience of understanding, the protective layer 2 is omitted in FIGS. 1 to 3. For convenience of understanding, a protective resin 78 to be described later is omitted in FIGS. 1 and 2. For convenience of understanding, a wire 61 to be described later is omitted in FIG. 2. In FIGS. 1 to 3, the lower side in a sub-scanning direction y corresponds to the upstream side, and the upper side in the sub-scanning direction y corresponds to the downstream side. In. FIGS. 4 to 6, the right side in the sub-scanning direction y corresponds to the upstream side, and the left side in the sub-scanning direction y corresponds to the downstream side.

The first substrate 1 supports the wiring layer 3 and the resistor layer 4, and corresponds to a substrate of the present disclosure. The first substrate 1 has an elongated rectangular shape having a main scanning direction x as a longitudinal direction and a sub-scanning direction y as a width direction. In the following description, a thickness direction of the first substrate 1 will be described as a thickness direction z. Although a size of the first substrate 1 is not particularly limited, for example, a thickness of the first substrate 1 is, for example, not less than 300 μm and not more than 1,000 μm, and is, for example, 725 μm. A dimension of the first substrate 1 in the main scanning direction x is, for example, not less than 25 mm and not more than 160 mm, and a dimension of the first substrate 1 in the sub-scanning direction y is, for example, not less than 1.0 mm and not more than 5.0 mm.

In the present embodiment, the first substrate 1 is made of a single crystal semiconductor, and is formed of, for example, Si. As shown in FIGS. 4 and 5, the first substrate 1 has a first main surface 11 and a first back surface 12. The first main surface 11 and the first back surface 12 face opposite sides from each other in the thickness direction z. The wiring layer 3 and the resistor layer 4 are formed on the first main surface 11 side. The first main surface 11 corresponds to a main surface of the present disclosure.

The first substrate 1 has a convex portion 13. The convex portion 13 protrudes from the first main surface 11 in the thickness direction z and extends in the main scanning direction x. In the shown example, the convex portion 13 is formed on the first substrate 1 near the downstream side in the sub-scanning direction y. Further, since the convex portion 13 is a part of the first substrate 1, the convex portion 13 is formed of Si which is a single crystal semiconductor.

In the present embodiment, the convex portion 13 includes a top portion 130, a pair of first inclined portions 131 and a pair of second inclined portions 132.

The top portion 130 of the convex portion 13 has the largest distance from the first main surface 11. In the present embodiment, the top portion 130 is formed of a plane parallel to the first main surface 11. The top portion 130 is an elongated rectangular plane that extends long in the main scanning direction x direction when viewed in the thickness direction z.

The pair of first inclined portions 131 is connected to both sides of the top portion 130 in the sub-scanning direction y. Each of the pair of first inclined portions 131 is inclined by an angle $\alpha 1$ with respect to the first main surface 11. The first inclined portion 131 is an elongated rectangular plane that extends in the main scanning direction x direction when viewed in the thickness direction z. In addition, the convex portion 13 may have inclined portions (not shown) connected to the pair of first inclined portions 131 and adjacent to both ends of the top portion 130 in the main scanning direction x.

The pair of second inclined portions 132 is connected to the pair of first inclined portions 131 on both sides in the sub-scanning direction y. Each of the pair of second inclined portions 132 is inclined by an angle $\alpha 2$, which is larger than the angle $\alpha 1$ with respect to the first main surface 11. The second inclined portion 132 is an elongated rectangular plane that extends in the main scanning direction x direction when viewed in the thickness direction z. In the present embodiment, the pair of second inclined portions 132 is connected to the first main surface 11. In addition, the convex portion 13 may have inclined portions (not shown) connected to the pair of second inclined portions 132 and located outside the main scanning direction x at both ends of the top portion 130 in the main scanning direction x.

In the present embodiment, the first main surface 11 is a (100) plane. According to a manufacturing method example to be described later, the angle $\alpha 1$ formed by the first inclined portion 131 with the first main surface 11 is 30.1 degrees, and the angle $\alpha 2$ formed by the second inclined portion 132 with the first main surface 11 is 54.8 degrees. The dimension of the convex portion 13 in the thickness direction z is, for example, not less than 100 μm and not more than 300 μm.

The first substrate 1 has a cavity portion 14. The cavity portion 14 overlaps a plurality of heat generating portions 41 of the resistor layer 4 to be described below when viewed in the z direction. In the present embodiment, the cavity portion 14 extends in the main scanning direction x and overlaps all of the plurality of heat generating portions 41 when viewed in the z direction. The first substrate 1 has a main plate portion 18. The main plate portion 18 is a portion which is located above the cavity portion 14 in the thickness direction z and closes the cavity portion 14 from the thickness direction z.

The size of each part of the cavity portion 14 and the main plate portion 18 is not particularly limited. As an example, the dimension of the cavity portion 14 in the thickness direction z is not less than 3 μm and not more than 10 μm, and the dimension thereof in the sub-scanning direction y is not less than 10 μm and not more than 30 μm. The dimension of the main plate portion 18 in the sub-scanning direction y is the same as the dimension of the cavity portion 14 in the sub-scanning direction y, and the dimension of the main plate portion 18 in the thickness direction z is not less than 1 μm and not more than 10 μm.

As shown in FIGS. 5 and 6, the insulating layer 19 covers the first main surface 11 and the convex portion 13 and serves to more reliably insulate the first main surface 11 side of the first substrate 1. The insulating layer 19 is made of an insulating material such as, for example, $SiO_2$, SiN or TEOS (tetraethyl orthosilicate). In the present embodiment, TEOS is used for the insulating layer 19. The thickness of the insulating layer 19 is not particularly limited, but it may be, for example, not more than 15 μm, more specifically, not more than 10 μm.

The resistor layer 4 is supported by the first substrate 1. In the present embodiment, the resistor layer 4 is supported by the first substrate 1 via the insulating layer 19. The resistor layer 4 has the plurality of heat generating portions 41. The plurality of heat generating portions 41 serves to locally heat a print medium by being selectively energized. The heat generating portions 41 are arranged along the main scanning direction x and are separated from each other in the main scanning direction x. A shape of the heat generating portion 41 is not particularly limited. In the present embodiment, each heat generating portion 41 has an elongated rectangular shape whose longitudinal direction corresponds to the sub-scanning direction y when viewed in the thickness direction z. The resistor layer 4 is made of, for example, TaN. The thickness of the resistor layer 4 is not particularly limited, but it may, for example, not less than 0.02 μm and not more than 0.1 μm, specifically, not less than 0.05 μm and not more than 0.07 μm.

As shown in FIGS. 3 and 6, in the present embodiment, the heat generating portion 41 includes a top portion 410, a pair of first portions 411 and a pair of second portions 412. The top portion 410 of the heat generating portion 41 is a portion formed on at least a part of the top portion 130 of the convex portion 13 in the sub-scanning direction y. The first portion 411 of the heat generating portion 41 is a portion formed on at least a part of the corresponding first inclined portion 131 of the convex portion 13 in the sub-scanning direction y. The second portion 412 of the heat generating portion 41 is a portion formed on at least a part of the corresponding second inclined portion 132 of the convex portion 13 in the sub-scanning direction y. In the present embodiment, the insulating layer 19 is interposed between the first substrate 1 and the resistor layer 4, but the insulating layer 19 is a sufficiently thin layer as described above. For this reason, when the heat generating portions 41 are formed so as to overlap with each other when viewed in the thickness direction z or when viewed in the normal direction of each of the top portion 130, the first inclined portion 131 and the second inclined portion 132, it is described that the heat generating portion 41 is formed on the top portion 130, the first the inclined portion 131, and the second inclined portion 132 and the same applies to the following.

In the present embodiment, the top portion 410 is formed over the entire length of the top portion 130 in the sub-scanning direction y. The heat generating portion 41 straddles boundaries between the top portion 130 and the pair of first inclined portions 131. The pair of first portions 411 is formed over the entire length of the pair of first inclined portions 131 in the sub-scanning direction y. The heat generating portion 41 straddles boundaries between the pair of first inclined portions 131 and the pair of second inclined portions 132. The pair of second portions 412 is formed only in a part of the pair of second inclined portions 132 in the sub-scanning direction y.

In the present embodiment, the dimension of the cavity portion 14 in the sub-scanning direction y is smaller than the dimension of the heat generating portion 41 in the sub-scanning direction y. The dimension of the cavity portion 14 in the sub-scanning direction y is smaller than the dimension of the top portion 130 of the convex portion 13 in the sub-scanning direction y. The cavity portion 14 overlaps the first inclined portion 131 of the convex portion 13 when viewed in the sub-scanning direction y. The cavity portion 14 is located closer to the top portion 130 than the first main surface 11 in the thickness direction z.

The wiring layer 3 serves to form an energizing path for energizing the plurality of heat generating portions 41. The wiring layer 3 is supported by the first substrate 1. In the present embodiment, as shown in FIGS. 5 and 6, the wiring layer 3 is stacked on the resistor layer 4. The wiring layer 3 is made of a metal material having lower resistance than the resistor layer 4, such as Cu. The wiring layer 3 may be configured to include a layer made of Cu and a layer made of Ti which is interposed between the layer made of Cu and the resistor layer 4 and has a thickness of not less than 15 nm and not more than 100 nm. The thickness of the wiring layer 3 is not particularly limited, but it may be, for example, not less than 0.3 μm and not more than 2.0 μm.

As shown in FIGS. 1 to 3, 5 and 6, in the present embodiment, the wiring layer 3 has a plurality of individual electrodes 31 and a common electrode 32. As shown in FIGS. 3 and 6, portions of the resistor layer 4 that are exposed from the wiring layer 3 between the plurality of individual electrodes 31 and the common electrode 32 constitute the plurality of heat generating portions 41.

As shown in FIGS. 3 and 6, each of the plurality of individual electrodes 31 has a band shape extending substantially in the sub-scanning direction y and is disposed on the upstream side of the plurality of heat generating portions 41 in the sub-scanning direction y. In the present embodiment, the downstream end of the individual electrode 31 in the sub-scanning direction y is disposed at a position overlapping the second inclined portion 132 of the convex portion 13 on the upstream side in the sub-scanning direction y. As shown in FIGS. 2 and 5, the individual electrode 31 has an individual pad 311. The individual pad 311 is a portion to which the wire 61 for making electrical conduction with the driver IC 7 is connected.

As shown in FIGS. 2, 3, 5 and 6, the common electrode 32 has a connection portion 323 and a plurality of band portions 324. The plurality of band portions 324 are arranged on the downstream side of the plurality of heat generating portions 41 in the sub-scanning direction y. The upstream ends of the plurality of band portions 324 in the sub-scanning direction y are opposed to the downstream ends of the plurality of individual electrodes 31 in the sub-scanning direction y with the heat generating portions 41 interposed therebetween. The upstream end of each band portion 324 in the sub-scanning direction y is disposed at a position overlapping the second inclined portion 132 of the convex portion 13 on the downstream side in the sub-scanning direction y. The connection portion 323 is located on the downstream side of the plurality of band portions 324 in the sub-scanning direction y and is connected with the plurality of band portions 324. The connection portion 323 is a relatively wide portion that extends in the main scanning direction x and has a dimension in the sub-scanning direction y that is larger than the dimension of the band portion 324 in the main scanning direction x. As shown in FIG. 1, the connection portion 323 extends from the downstream side of the plurality of heat generating portions 41 in the sub-scanning direction y to the upstream side thereof in the sub-scanning direction y, while bypassing both sides thereof in the main scanning direction x.

In the present embodiment, the downstream side portions of the plurality of band portions 324 in the sub-scanning direction y and the connection portion 323 are formed on the first main surface 11 of the first substrate 1.

The protective layer 2 covers the wiring layer 3 and the resistor layer 4. The protective layer 2 is made of an insulating material and serves to protect the wiring layer 3 and the resistor layer 4. The material of the protective layer 2 is, for example, $SiO_2$, SiN, SiC, AlN or the like, and is composed of a single layer or a plurality of layers. The thickness of the protective layer 2 is not particularly limited, but it may be, for example, not less than 1.0 μm and not more than 10 μm.

As shown in FIG. 5, in the present embodiment, the protective layer 2 has a pad opening 21. The pad opening 21 penetrates through the protective layer 2 in the thickness direction z. A plurality of pad openings 21 may be formed to expose the plurality of individual pads 311 of the individual electrodes 31.

The second substrate 5 is disposed on the upstream side of the first substrate 1 in the sub-scanning direction y, as shown in FIGS. 1 and 4. The second substrate 5 may be, for example, a PCB substrate on which the driver IC 7 and a connector 59 to be described later are mounted. The shape or the like of the second substrate 5 is not particularly limited. In the present embodiment, the second substrate 5 has a long rectangular shape whose longitudinal direction is the main scanning direction x. The second substrate 5 has a second main surface 51 and a second back surface 52. The second main surface 51 is a surface facing the same side as the first main surface 11 of the first substrate 1, and the second back surface 52 is a surface facing the same side as the first back surface 12 of the first substrate 1. In the present embodiment, the second main surface 51 is located below the first main surface 11 in the thickness direction z.

The driver IC 7 is mounted on the second main surface 51 of the second substrate 5 and serves to individually energize the plurality of heat generating portions 41. In the present embodiment, the driver IC 7 is connected to the plurality of individual electrodes 31 by a plurality of wires 61. The energization control of the driver IC 7 is performed according to a command signal input from the outside of the thermal print head A1 via the second substrate 5. The driver IC 7 is connected to a wiring layer (not shown) of the second substrate 5 by a plurality of wires 62. In the present embodiment, a plurality of driver ICs 7 are provided according to the number of the plurality of heat generating portions 41.

The driver IC 7, the plurality of wires 61, and the plurality of wires 62 are covered with the protective resin 78. The protective resin 78 is formed of, for example, an insulating resin and is, for example, black. The protective resin 78 is formed so as to straddle the first substrate 1 and the second substrate 5.

The connector 59 is used to connect the thermal print head A1 to a printer (not shown). The connector 59 is attached to the second substrate 5 and is connected to the wiring layer (not shown) of the second substrate 5.

The heat radiating member 8 supports the first substrate 1 and the second substrate 5, and radiates some of heat generated by the plurality of heat generating portions 41 to the outside via the first substrate 1. The heat radiating member 8 is a block-shaped member made of metal such as aluminum. In the present embodiment, the heat radiating member 8 has a first support surface 81 and a second support surface 82. The first support surface 81 and the second support surface 82 each face upward in the thickness direction z and are arranged side by side in the sub-scanning direction y. The first back surface 12 of the first substrate 1 is joined to the first support surface 81. The second back surface 52 of the second substrate 5 is joined to the second support surface 82.

Next, an example of a method of manufacturing the thermal print head A1 will be described below with reference to FIGS. 7 to 18.

Figure 7:
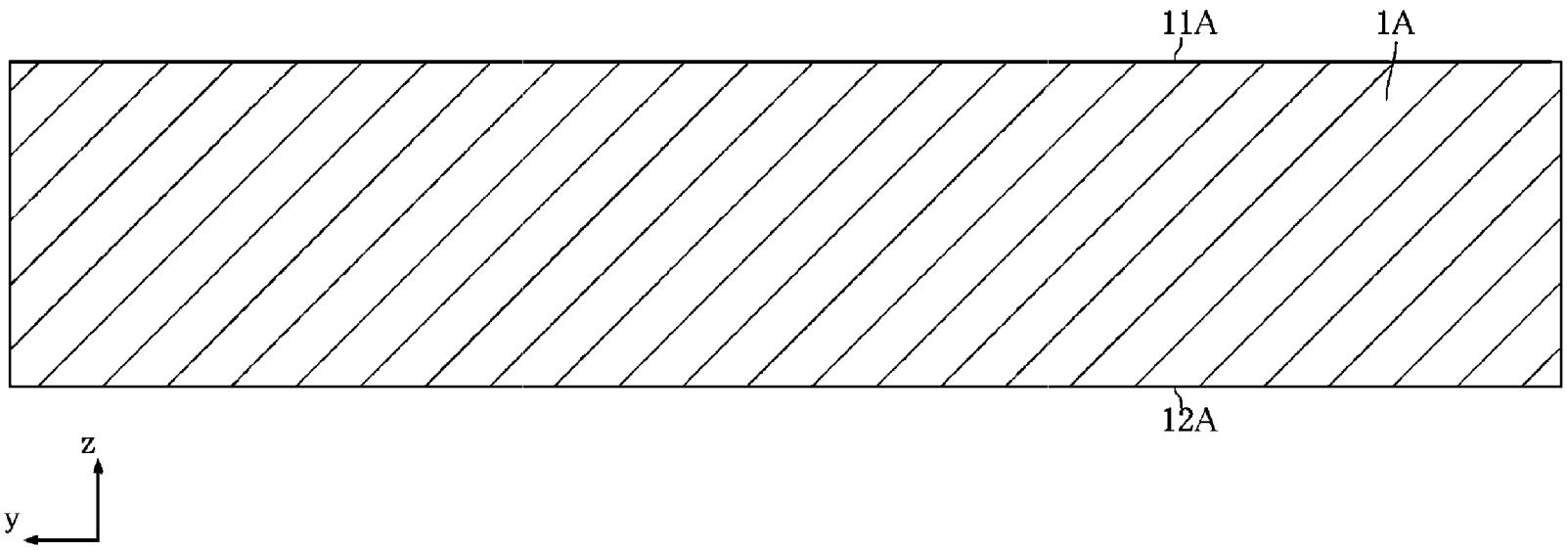
FIG. 7 is a main part cross-sectional view showing an example of a method of manufacturing the thermal print head according to the first embodiment of the present disclosure.

First, as shown in FIG. 7, a substrate material 1A is prepared. The substrate material 1A is made of a single crystal semiconductor and is, for example, a Si wafer. The thickness of the substrate material 1A is not particularly limited. In the present embodiment, the thickness of the substrate material 1A is, for example, not less than 300 μm and not more than 1,000 μm, and is for example, 725 μm. The substrate material 1A has a main surface 11A and a back surface 12A facing opposite sides from each other. The main surface 11A is a (100) plane.

Figure 8:
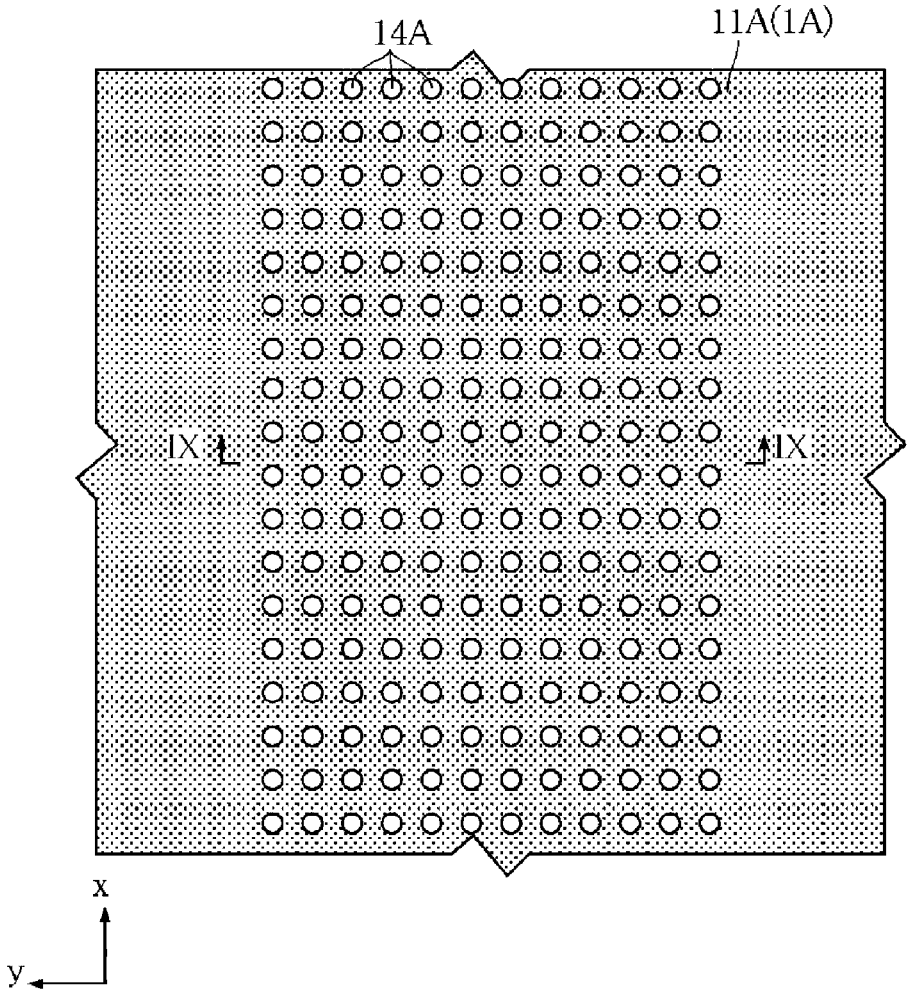
FIG. 8 is an enlarged main part plan view showing an example of a method of manufacturing the thermal print head according to the first embodiment of the present disclosure.
Figure 9:
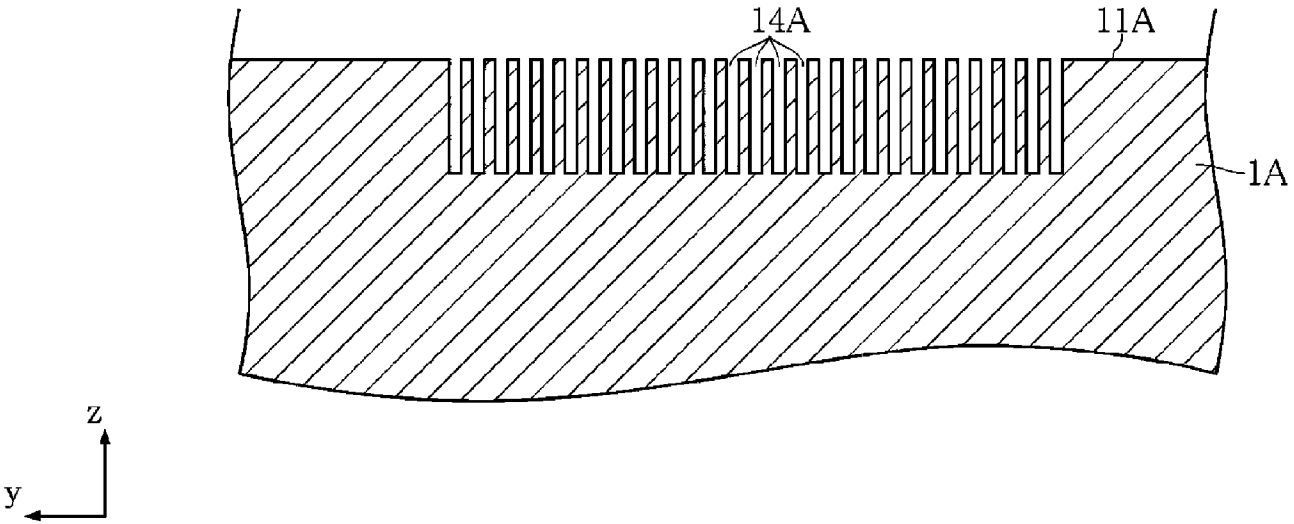
FIG. 9 is a cross-sectional view taken along line IX-IX of FIG. 8.

Next, as shown in FIGS. 8 and 9, a hole forming step is performed. FIG. 8 is a plan view of a main part of the substrate material 1A, and FIG. 9 is an enlarged cross-sectional view of the main part, which is taken along line IX-IX in FIG. 8. The main surface 11A of the substrate material 1A is subjected to deep etching such as a Bosch process. Thus, a plurality of holes 14A is formed. The arrangement of the holes 14A is not particularly limited. In the present embodiment, as shown in FIG. 8, the holes 14A are formed in a matrix. The holes 14A are formed in a band-like region extending long in the main scanning direction x. In the present embodiment, as shown in FIG. 9, deep etching (Bosch process and the like) is performed so that the cross-sectional areas of the holes 14A perpendicular to the thickness direction z are substantially uniform in the thickness direction z.

Figure 10:
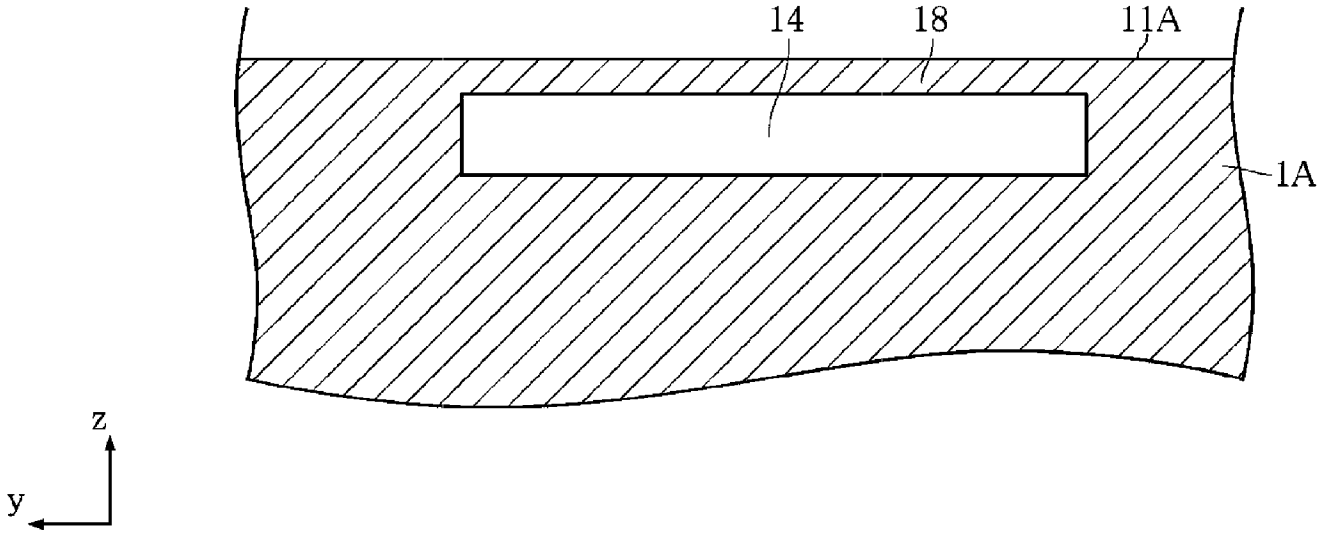
FIG. 10 is an enlarged main part cross-sectional view showing an example of a method of manufacturing the thermal print head according to the first embodiment of the present disclosure.

Next, as shown in FIG. 10, a cavity-forming step is performed. The cavity-forming step includes a process of interconnecting the bottom portions of the holes 14A and a process of closing the opening portions of the holes 14A. In the present embodiment, heat treatment in a reducing atmosphere is used. Specifically, for example, hydrogen annealing is used to move the single crystal semiconductor of the substrate material 1A partially, thereby collectively performing the process of interconnecting the bottom portions of the holes 14A and the process of closing the opening portions of the holes 14A. This hydrogen annealing is performed, for example, by heating the substrate material 1A to 1,000 degrees C. to 1,200 degrees C. in a hydrogen atmosphere under reduced pressure and maintaining this state for a predetermined time. Thus, the cavity portion 14 in which the bottom portions of the holes 14A are connected to each other is formed. In addition, by interconnecting the opening portions of the holes 14A, the main plate portion 18 that closes these openings is formed. The upper surface of the main plate portion 18 forms a part of the main surface 11A, and the lower surface of the main plate portion 18 forms a part of the inner surface of the cavity portion 14. In the present embodiment, the cavity portion 14 is sealed by the main plate portion 18 in a state where the cavity-forming step is completed. Since the cavity portion 14 is formed in the sealed state in a hydrogen atmosphere at 1,000 degrees C. to 1,200 degrees C., an internal pressure of the cavity portion 14 is lower than the normal atmospheric pressure. However, the cavity portion 14 may not be sealed, for example, by leaving some of the holes 14A. As an example of the dimensions of the cavity portion 14 and the main plate portion 18 formed through the cavity-forming step in the thickness direction z, the dimension (depth) of the cavity portion 14 in the thickness direction z is not less than 3 μm and not more than 10 μm, and the dimension (thickness) of the main plate portion 18 in the thickness direction z is not less than 1 μm and not more than 10 μm.

Figure 11:
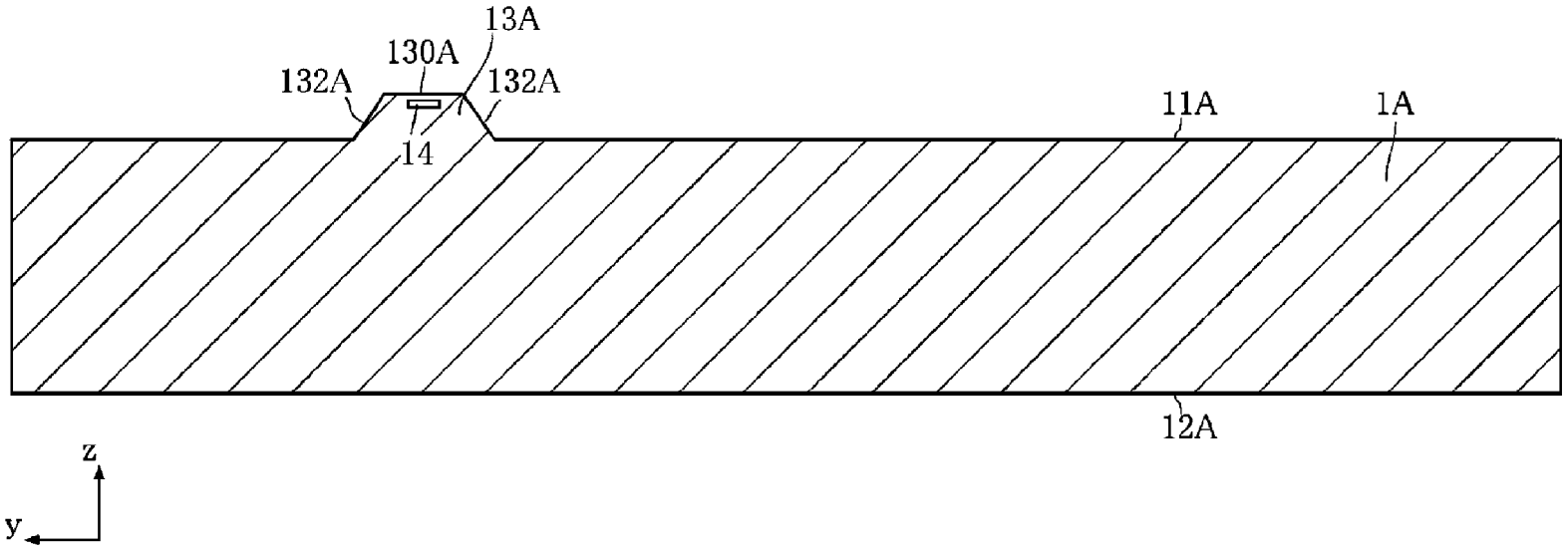
FIG. 11 is a main part cross-sectional view showing an example of the method of manufacturing the thermal print head according to the first embodiment of the present disclosure.
Figure 12:
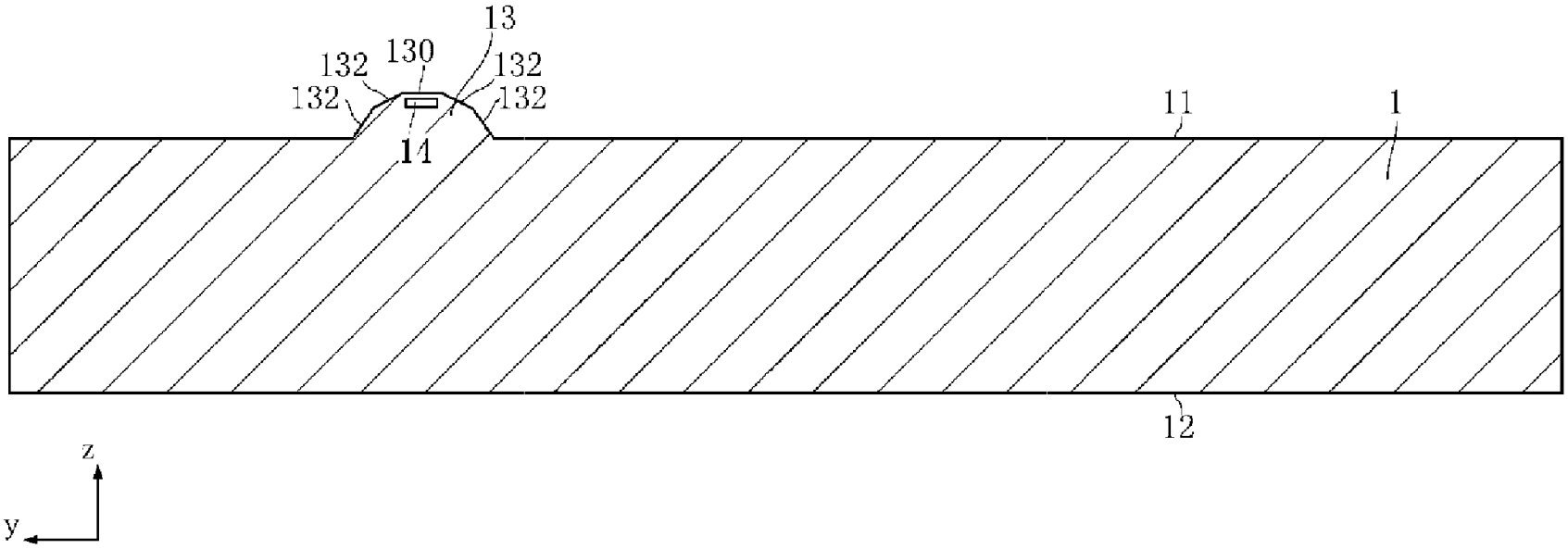
FIG. 12 is a main part cross-sectional view showing an example of the method of manufacturing the thermal print head according to the first embodiment of the present disclosure.
Figure 13:
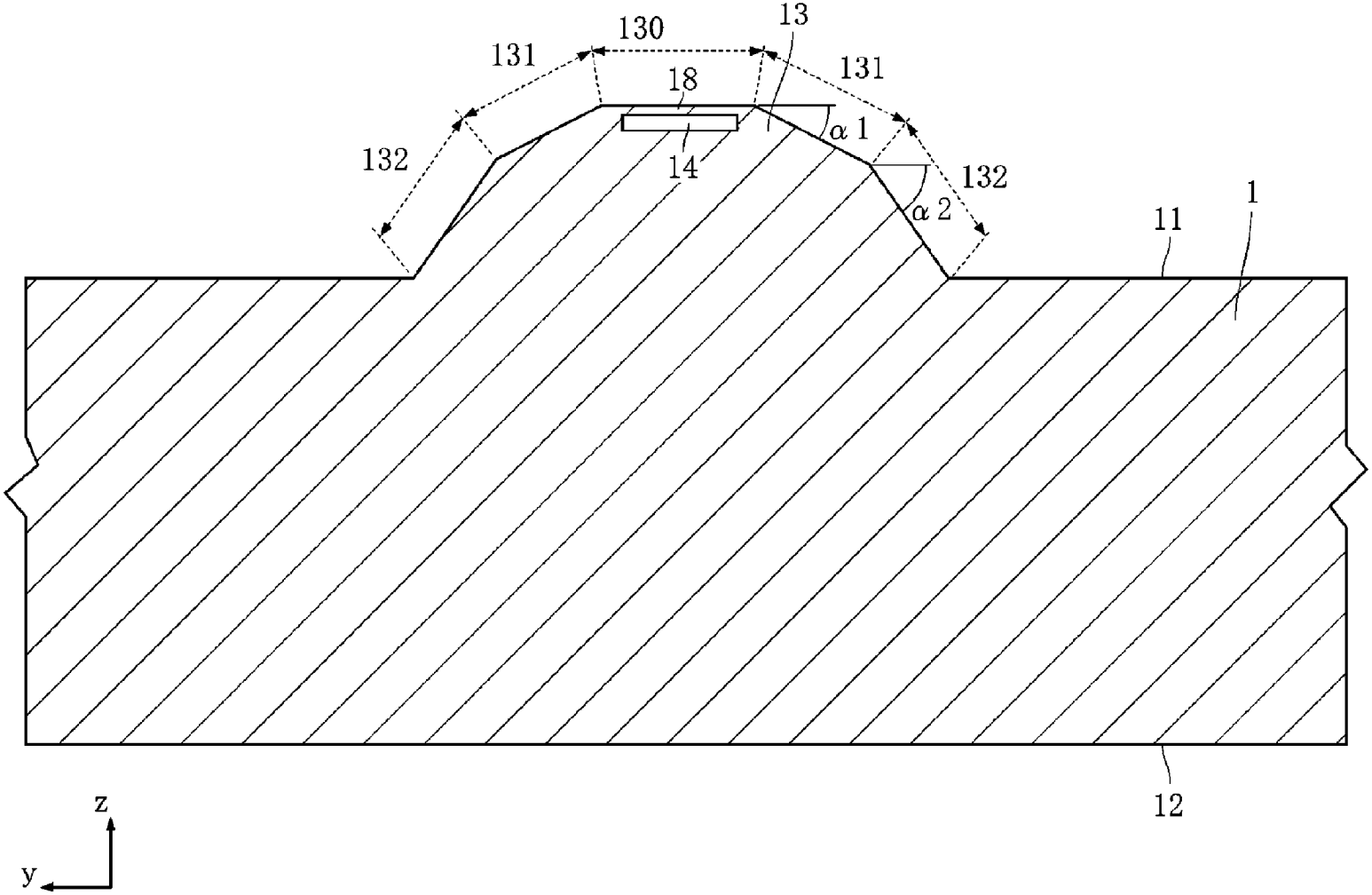
FIG. 13 is an enlarged main part cross-sectional view showing an example of the method of manufacturing the thermal print head according to the first embodiment of the present disclosure.

Next, after covering the main surface 11A with a predetermined mask layer, anisotropic etching using, for example, KOH is performed. This mask layer is provided so as to overlap the cavity portion 14 when viewed in the thickness direction z. Thus, as shown in FIG. 11, the convex portion 13A is formed on the substrate material 1A. The convex portion 13A protrudes from the main surface 11A and extends in the main scanning direction x. The convex portion 13A has a top portion 130A and a pair of inclined portions 132A. The top portion 130A is a plane parallel to the main surface 11A. In the present embodiment, the top portion 130A is a (100) plane. The pair of inclined portions 132A is located on both sides of the top portion 130A in the sub-scanning direction y and is interposed between the top portion 130A and the main surface 11A. The inclined portion 132A is a plane inclined with respect to the top portion 130A and the main surface 11A. In the present embodiment, an angle formed by the inclined portion 132A, the main surface 11A, and the top portion 130A is 54.8 degrees.

Next, after removing the mask layer, etching using, for example, KOH is performed again. Thus, the substrate material 1A becomes the first substrate 1 having the first main surface 11, the first back surface 12, and the convex portion 13 shown in FIGS. 12 and 13. The convex portion 13 has the top portion 130, the pair of first inclined portions 131, and the pair of second inclined portions 132. The top portion 130 is a portion that was the top portion 130A, and the pair of second inclined portions 132 is a portion that was the pair of inclined portions 132A. The pair of first inclined portions 131 is a portion where the boundaries between the top portion 130A and the pair of inclined portions 132A is etched by KOH. The angle $\alpha 1$ formed by the pair of first inclined portions 131 with the first main surface 11 is 30.1 degrees, and the angle $\alpha 2$ formed by the pair of second inclined portions 132 with the first main surface 11 is 54.8 degrees.

Figure 14:
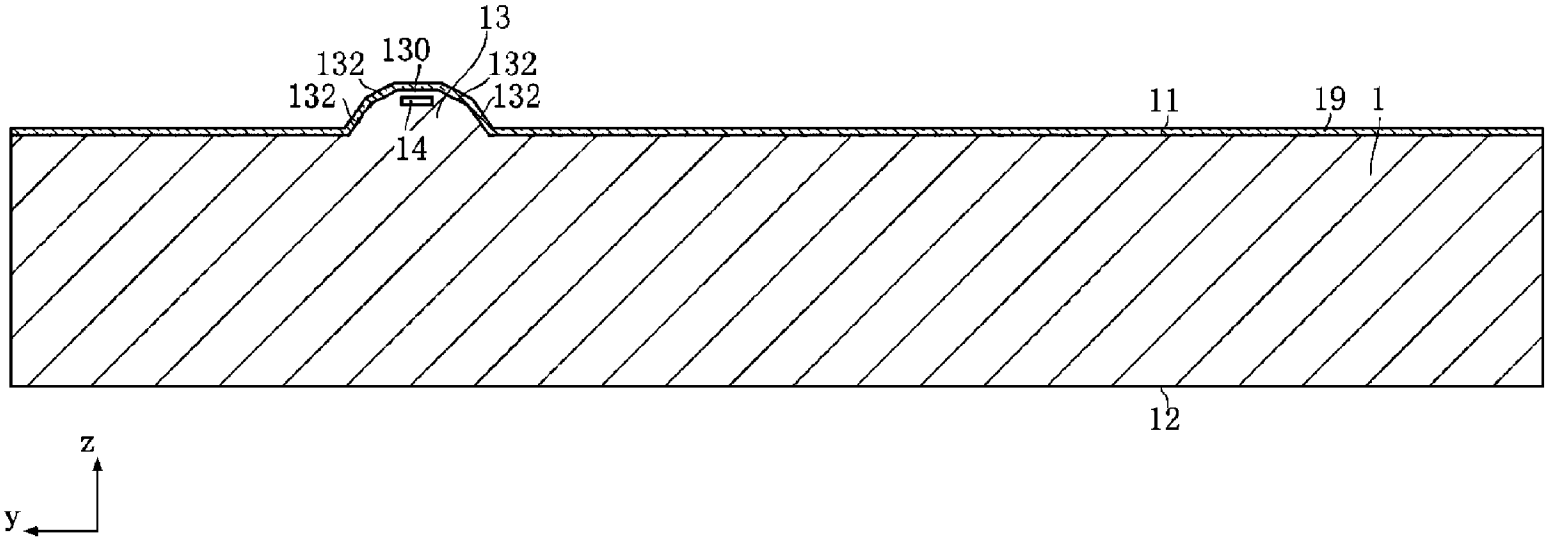
FIG. 14 is a main part cross-sectional view showing an example of the method of manufacturing the thermal print head according to the first embodiment of the present disclosure.

Next, as shown in FIG. 14, the insulating layer 19 is formed. The insulating layer 19 is formed, for example, by depositing TEOS on a reflective layer 15 using CVD.

Figure 15:
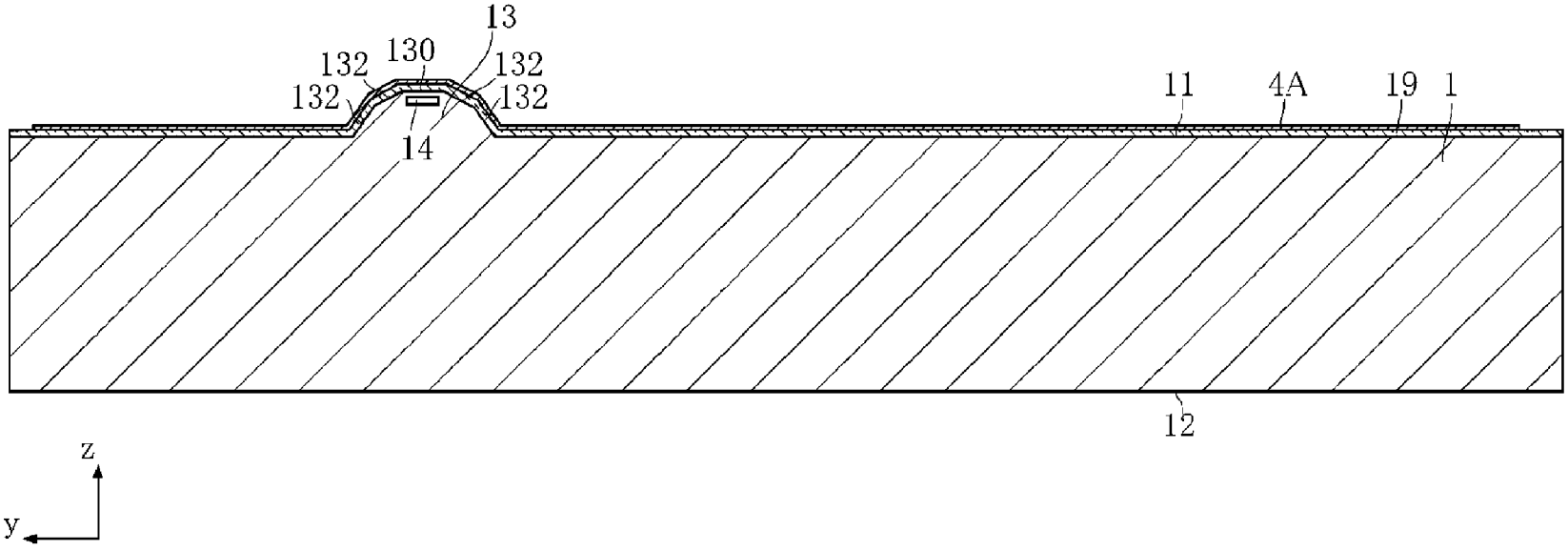
FIG. 15 is a main part cross-sectional view showing an example of the method of manufacturing the thermal print head according to the first embodiment of the present disclosure.

Next, as shown in FIG. 15, a resistor film 4A is formed. The resistor film 4A is formed, for example, by forming a TaN thin film on the insulating layer 19 by sputtering.

Figure 16:
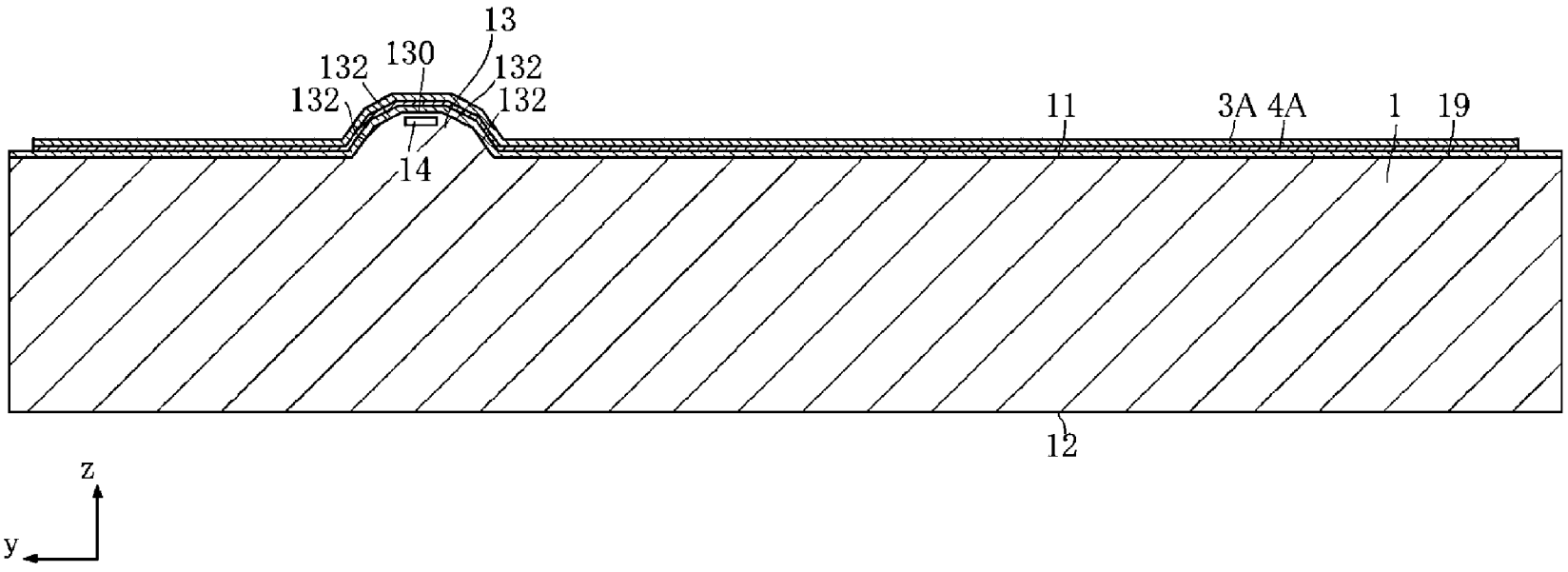
FIG. 16 is a main part cross-sectional view showing an example of the method of manufacturing the thermal print head according to the first embodiment of the present disclosure.

Next, as shown in FIG. 16, a conductive film 3A that covers the resistor film 4A is formed. The conductive film 3A is formed, for example, by forming a layer made of Cu by plating or sputtering. Further, a Ti layer may be formed before forming the Cu layer.

Figure 17:
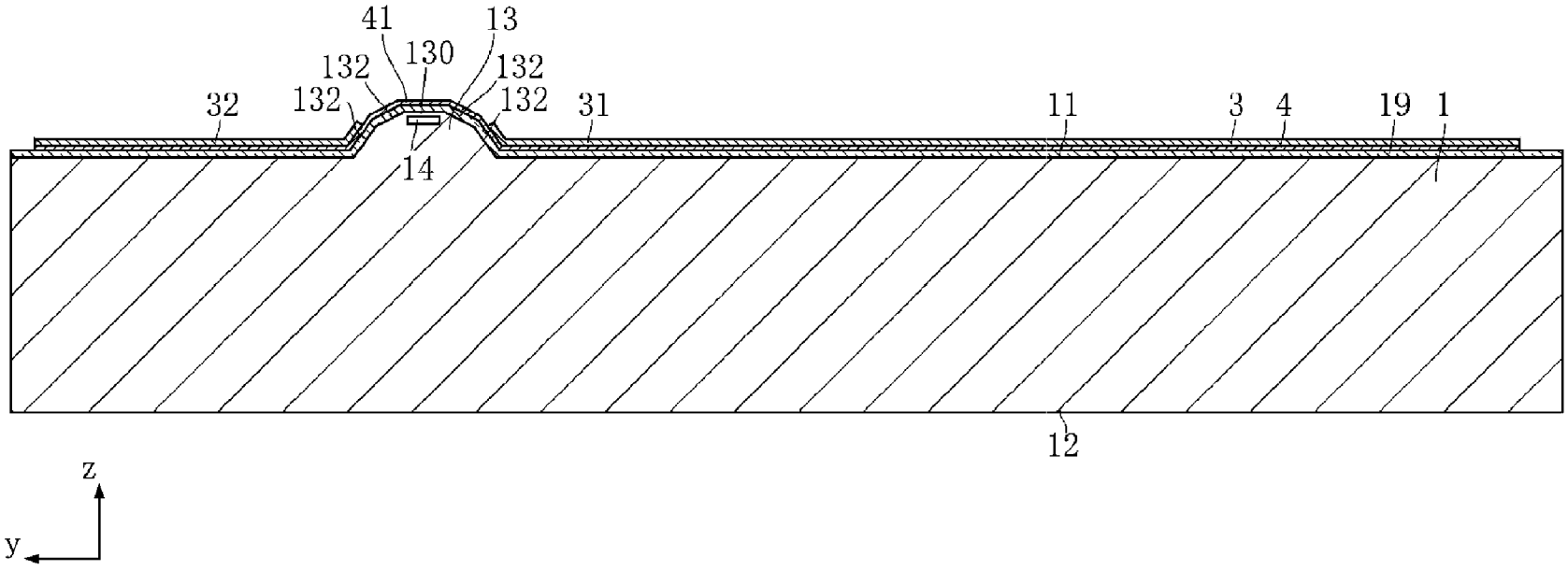
FIG. 17 is a main part cross-sectional view showing an example of the method of manufacturing the thermal print head according to the first embodiment of the present disclosure.
Figure 18:
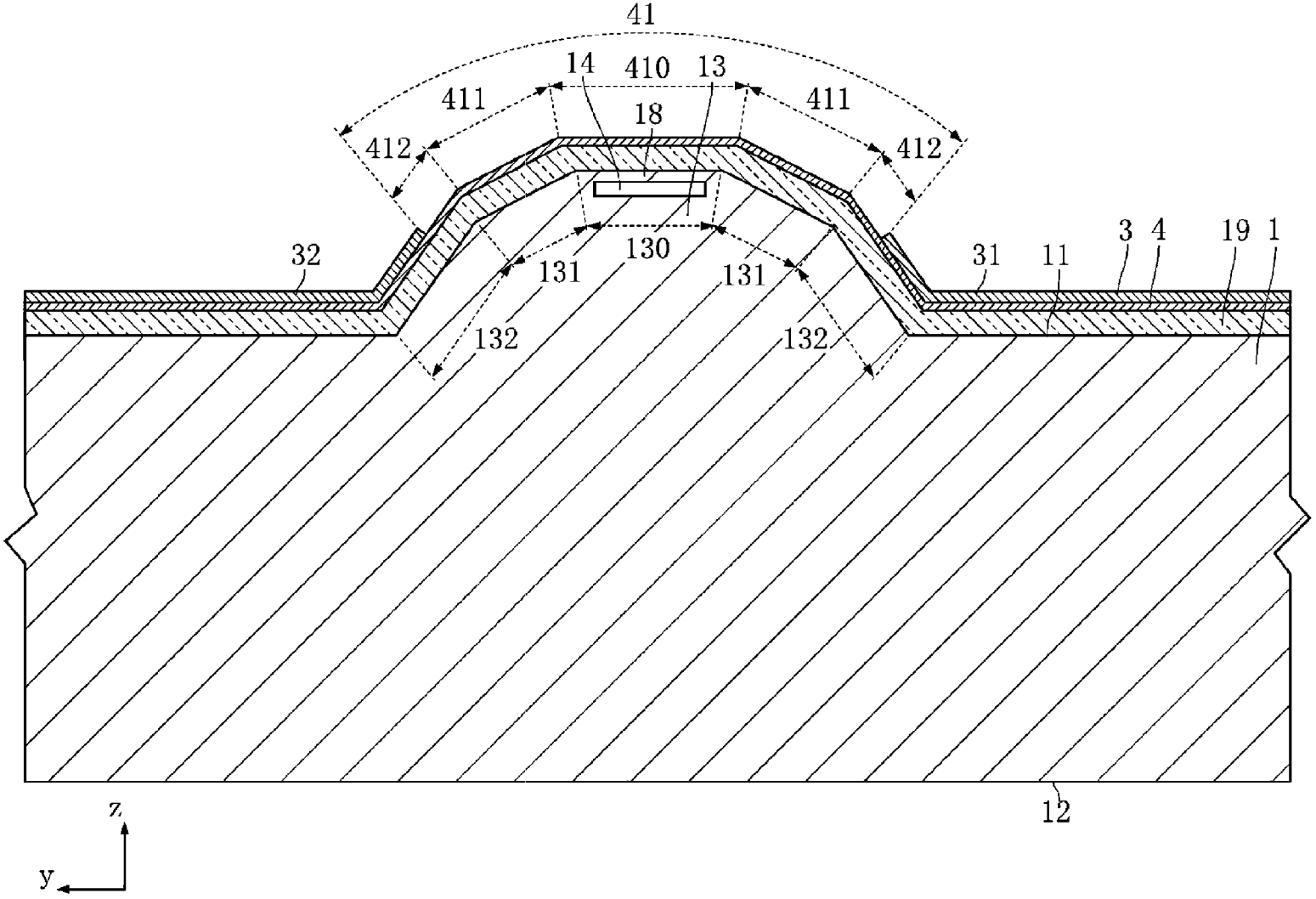
FIG. 18 is an enlarged main part cross-sectional view showing an example of the method of manufacturing the thermal print head according to the first embodiment of the present disclosure.

Next, as shown in FIGS. 17 and 18, the wiring layer 3 and the resistor layer 4 are obtained by selectively etching the conductive film 3A and selectively etching the resistor film 4A. The wiring layer 3 has the plurality of individual electrodes 31 and the common electrode 32 described above. The resistor layer 4 has the plurality of heat generating portions 41.

Next, the protective layer 2 is formed. The protective layer 2 is formed, for example, by depositing SiN and SiC on the insulating layer 19, the wiring layer 3, and the resistor layer 4 using CVD. In addition, the pad opening 21 is formed by partially removing the protective layer 2 by etching or the like. Thereafter, the above-described thermal print head A1 is obtained through mounting of the first substrate 1 and the second substrate 5 on the first support surface 81, mounting of the driver IC 7 on the second substrate 5, bonding of the plurality of wires 61 and the plurality of wires 62, formation of the protective resin 78, and the like.

Next, the operation of the thermal print head A1 and the method of manufacturing the thermal print head A1 will be described.

According to the present embodiment, the cavity portion 14 is formed in the first substrate 1. The cavity portion 14 overlaps the heat generating portions 41 in the thickness direction z. This makes it possible to suppress the amount of heat that escapes to the first back surface 12 via the first substrate 1 when the heat generating portions 41 generate heat by the resistor layer 4 being energized. As a result, it is possible to transfer more heat to printing paper. Therefore, according to the thermal print head A1, it is possible to improve printing energy efficiency and printing quality.

When the first substrate 1 is made of Si, the thermal conductivity of the first substrate 1 is relatively high. Therefore, it is possible to prevent heat from the heat generating portions 41 from excessively escaping to the first back surface 12 through the first substrate 1. On the other hand, in a region clearly retracted from the heat generating portions 41 when viewed in the thickness direction z, unnecessary heat can be quickly transferred to the first back surface 12 side and the like.

The convex portion 13 of the first substrate 1 has the top portion 130 and the first inclined portions 131. The heat generating portion 41 has the top portion 410 formed on the top portion 130 and the first portions 411 formed on the first inclined portions 131, and is formed to straddle the boundaries between the top portion 130 and the first inclined portions 131. Therefore, as shown in FIG. 4, when the platen roller 91 is pressed against the thermal print head A1, the platen roller 91 is elastically deformed so that it makes contact with one or both of the top portion 410 and the first portions 411. As shown in FIG. 4, when the center 910 of the platen roller 91 is aligned with the center of the convex portion 13 in the sub-scanning direction y, the platen roller 91 contacts the top portion 410 with a strong pressure. On the other hand, if the center 910 of the platen roller 91 is unintentionally shifted in the sub-scanning direction y with respect to the center of the convex portion 13, the pressure between the platen roller 91 and the top portion 410 decreases. However, in the present embodiment, since the heat generating portion 41 has the first portions 411, even when the platen roller 91 is shifted, a ratio of the platen roller 91 in contact with the first portions 411 increases and the platen roller 91 is still appropriately pressed against the heat generating portion 41. Therefore, according to the thermal print head A1, even when the platen roller 91 is unintentionally shifted or a diameter of the platen roller 91 is varied, it is possible to suppress a decrease in print quality and to improve the printing quality.

In addition, in the present embodiment, the top portion 410 is formed over the entire length of the top portion 130 in the sub-scanning direction y, and the pair of first portions 411 is formed on both sides of the top portion 410 in the sub-scanning direction y. Therefore, even when the shift of the platen roller 91 occurs on either the upstream side or the downstream side in the sub-scanning direction y, it is possible to suppress a decrease in print quality. Further, the pair of first portions 411 is formed over the entire length of the first inclined portions 131 in the sub-scanning direction y. This is preferable for suppressing a decrease in print quality when the platen roller 91 is unintentionally shifted.

In addition, in the present embodiment, the convex portion 13 has the pair of second inclined portions 132. That is, the convex portion 13 has a configuration where the first inclined portions 131 and the second inclined portions 132, which are inclined in two steps with respect to the top portion 130 (the first main surface 11), are arranged in the sub-scanning direction y. Therefore, the angle formed by the top portion 130 and the first inclined portions 131 can be reduced, which may improve the printing quality. In addition, as the angle between the top portion 130 and the first inclined portions 131 gets smaller, abrasion of the protective layer 2, which may occur when the printing paper passes during printing, can be suppressed. Further, since the first portions 411 are formed over the entire length of the first inclined portions 131 in the sub-scanning direction y, ends of the individual electrodes 31 and the common electrode 32 in the sub-scanning direction y are not located on the pair of first inclined portions 131 but are located on the pair of second inclined portions 132. For this reason, it is possible to avoid occurrence of a step due to presence of an edge of the wiring layer 3 at a position overlapping the first inclined portions 131, which is advantageous for smooth passage of the printing paper and prevention of adhesion of paper debris. Further, the formation of the pair of second portions 412 may suppress a decrease in print quality when the platen roller 91 is unintentionally shifted.

Since the cavity portion 14 overlaps the top portion 130 when viewed in the thickness direction z and the dimension of the cavity portion 14 in the sub-scanning direction y is smaller than that of the top portion 130, it is possible to prevent excessive heat from escaping from a part of the heat generating portions 41 that is strongly pressed against the platen roller 91. This may suppress a decrease in print quality. In addition, when the cavity portion 14 is formed at a position overlapping the first inclined portions 131 when viewed in the sub-scanning direction y, the cavity portion 14 may be closer to the heat generating portions 41, which may suppress heat transfer.

FIGS. 19 to 23 show modifications and other embodiments of the present disclosure. In these figures, the same or similar elements as those in the aforementioned embodiments are denoted by the same reference numerals as those in the aforementioned embodiments.

Modification of First Embodiment

Figure 19:
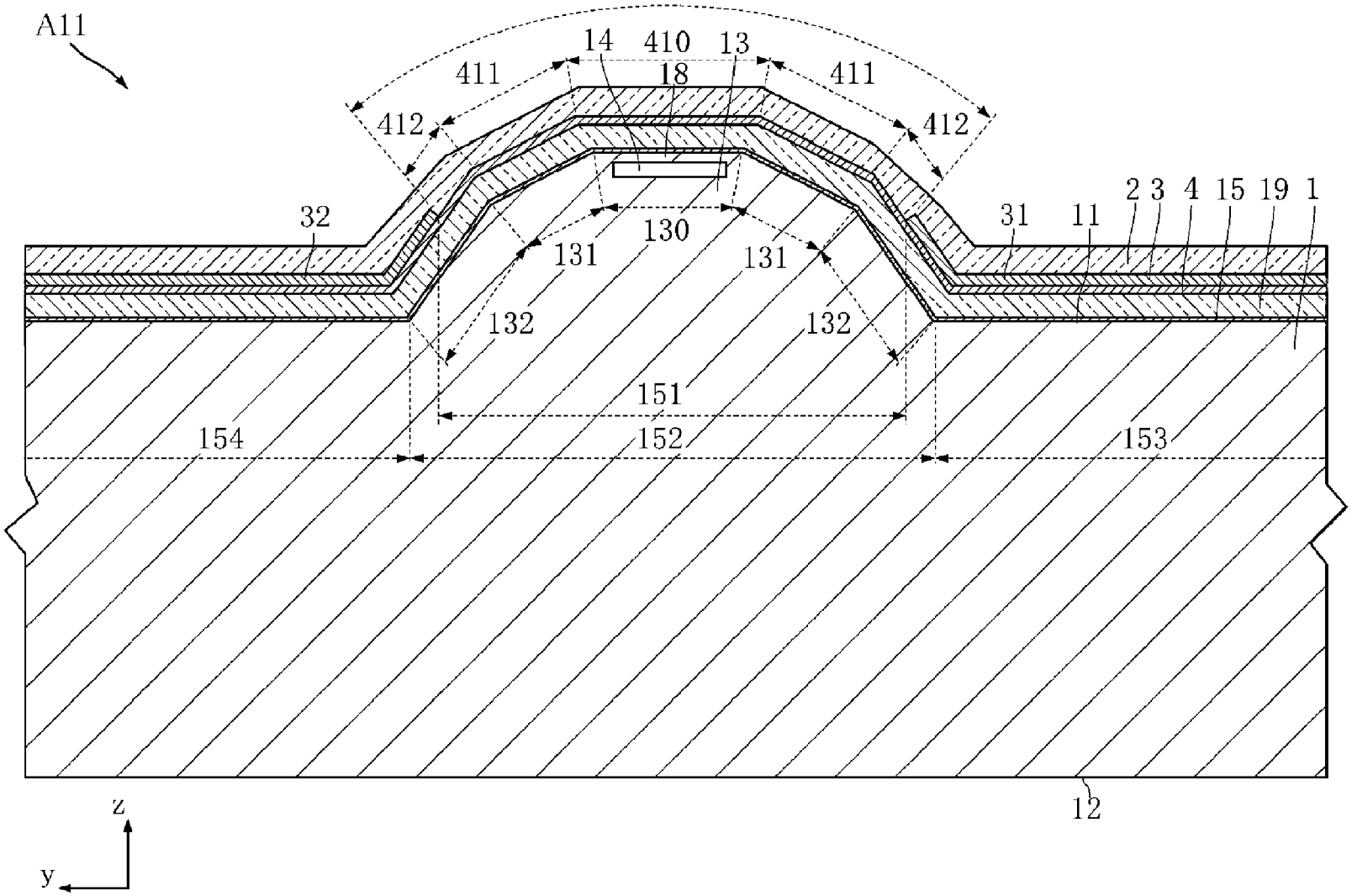
FIG. 19 is an enlarged main part cross-sectional view showing a modification of the thermal print head according to the first embodiment of the present disclosure.

FIG. 19 is an enlarged main part cross-sectional view showing a modification of the thermal print head A1. A thermal print head A11 of this modification has a reflective layer 15.

The reflective layer 15 is formed at a side opposite the resistor layer 4 with respect to the insulating layer 19. In the present embodiment, the reflective layer 15 is interposed between the insulating layer 19 and the first substrate 1. The reflective layer 15 is made of a material having a higher thermal reflectance than the insulating layer 19. In the present disclosure, the thermal reflectance is a physical property value in which a sum of transmittance and absorptance of heat received by an object due to heat emission (also referred to as radiation) is 1. That is, a material having a lower transmittance or absorptance tends to have a higher thermal reflectance. The material of the reflective layer 15 is not particularly limited, but it may be metal such as Cu, Ti, Al or the like. In the shown example, the reflective layer 15 is made of Cu. In addition, the thickness of the reflective layer 15 is not particularly limited. In the present embodiment, for example, the thickness of the reflective layer 15 is thinner than the wiring layer 3 and is, for example, not less than 0.05 μm and not more than 0.3 μm, more specifically, not less than 0.08 μm and not more than 0.15 μm. The reflective layer 15 can be formed by, for example, sputtering or CVD.

The reflective layer 15 is formed at a position overlapping the plurality of heat generating portions 41 when viewed in a thickness direction of a portion (which will be described later) of the resistor layer 4 forming the heat generating portions 41, the thickness direction z in the present embodiment. In the shown example, the reflective layer 15 covers all of the first main surface 11 and the convex portion 13 of the first substrate 1 and includes a first reflective portion 151, a second reflective portion 152, a third reflective portion 153, and a fourth reflective portion 154.

The first reflective portion 151 is a portion that overlaps the heat generating portions 41 when viewed in the z direction. The second reflective portion 152 is a portion that overlaps the convex portion 13 when viewed in the z direction. In the shown example, the first reflective portion 151 is included in the second reflective portion 152. The third reflective portion 153 is a portion located on the upstream side of the second reflective portion 152 in the y direction and overlaps the first main surface 11 when viewed in the z direction. The fourth reflective portion 154 is a portion located on the downstream side of the second reflective portion 152 in the y direction and overlaps the first main surface 11 when viewed in the z direction.

The reflective layer 15 of this example is insulated from the wiring layer 3 and the resistor layer 4. That is, the insulating layer 19 is interposed between the reflective layer 15 and the resistor layer 4 as well as the wiring layer 3 over the entire area.

This modification may achieve the same operational effects as those of the thermal print head A1. Further, according to the configuration of including the insulating layer 19, in a case where the plurality of heat generating portions 41 generate heat when electricity is supplied to the resistor layer 4, heat transmitted from the heat generating portions 41 through the insulating layer 19 due to heat emission can be reflected toward the heat generating portions 41 by the reflective layer 15. This makes it possible to prevent the heat from escaping to the first back surface 12 side through the first substrate 1 and to transmit more heat to the printing paper. Therefore, according to the thermal print head A11, the printing energy efficiency and the printing quality can be improved.

Second Embodiment

Figure 20:
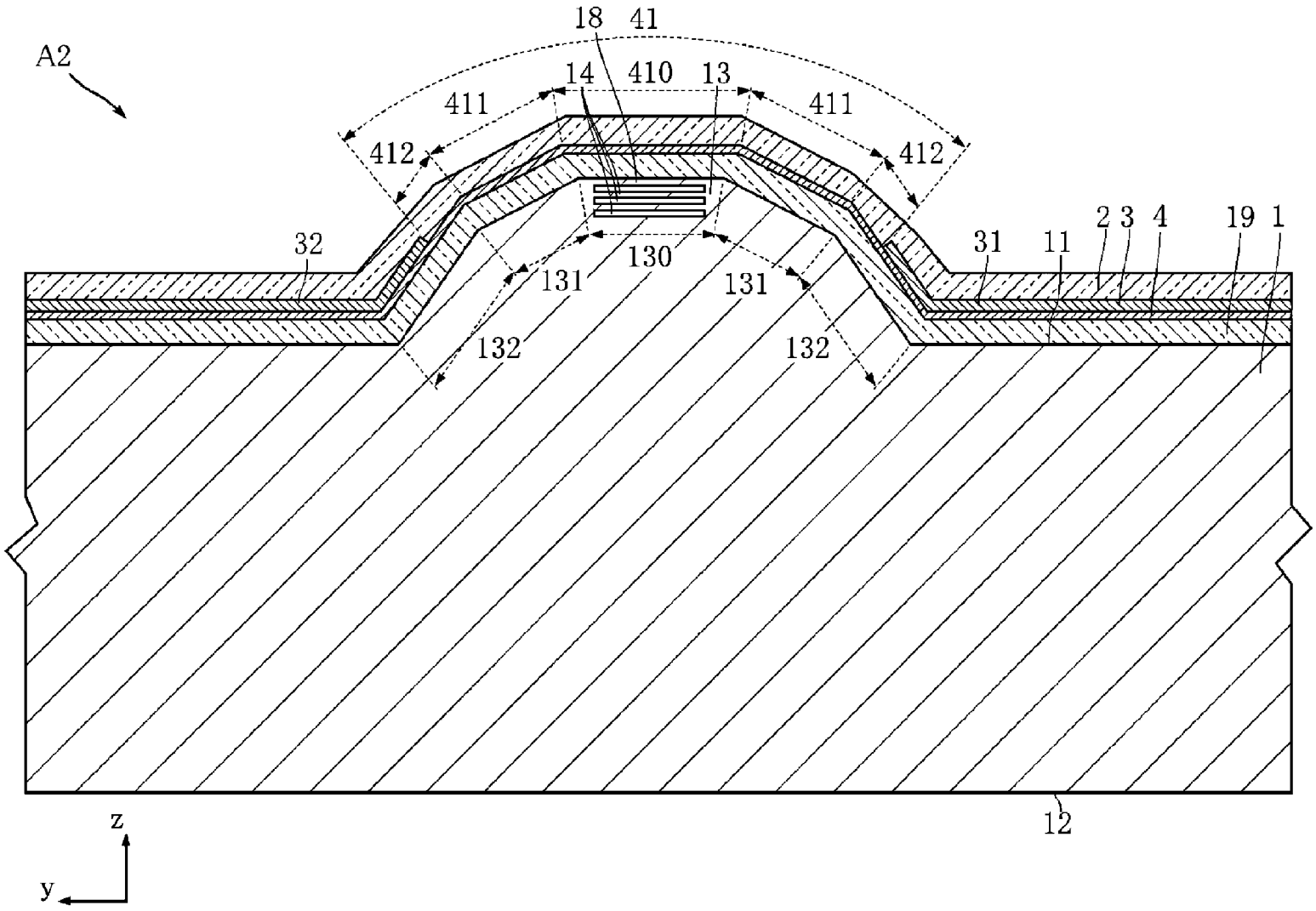
FIG. 20 is an enlarged main part cross-sectional view showing a thermal print head according to a second embodiment of the present disclosure.

FIG. 20 is an enlarged main part cross-sectional view showing a thermal print head according to a second embodiment of the present disclosure. The thermal print head A2 of the second embodiment is different from the first embodiment in that the first substrate 1 has a plurality of cavity portions 14.

The cavity portions 14 are arranged in the z direction to overlap each other when viewed in the z direction. Such cavity portions 14 can be formed, for example, by appropriately setting the depth (aspect ratio) and formation density of the holes 14A in the manufacturing method shown in FIGS. 8 and 9.

According to the second embodiment, the printing energy efficiency and the printing quality can be improved by suppressing excessive heat transfer. Further, as can be understood from the second embodiment, the number of cavity portions 14 formed in the first substrate 1 is not particularly limited.

Third Embodiment

Figure 21:
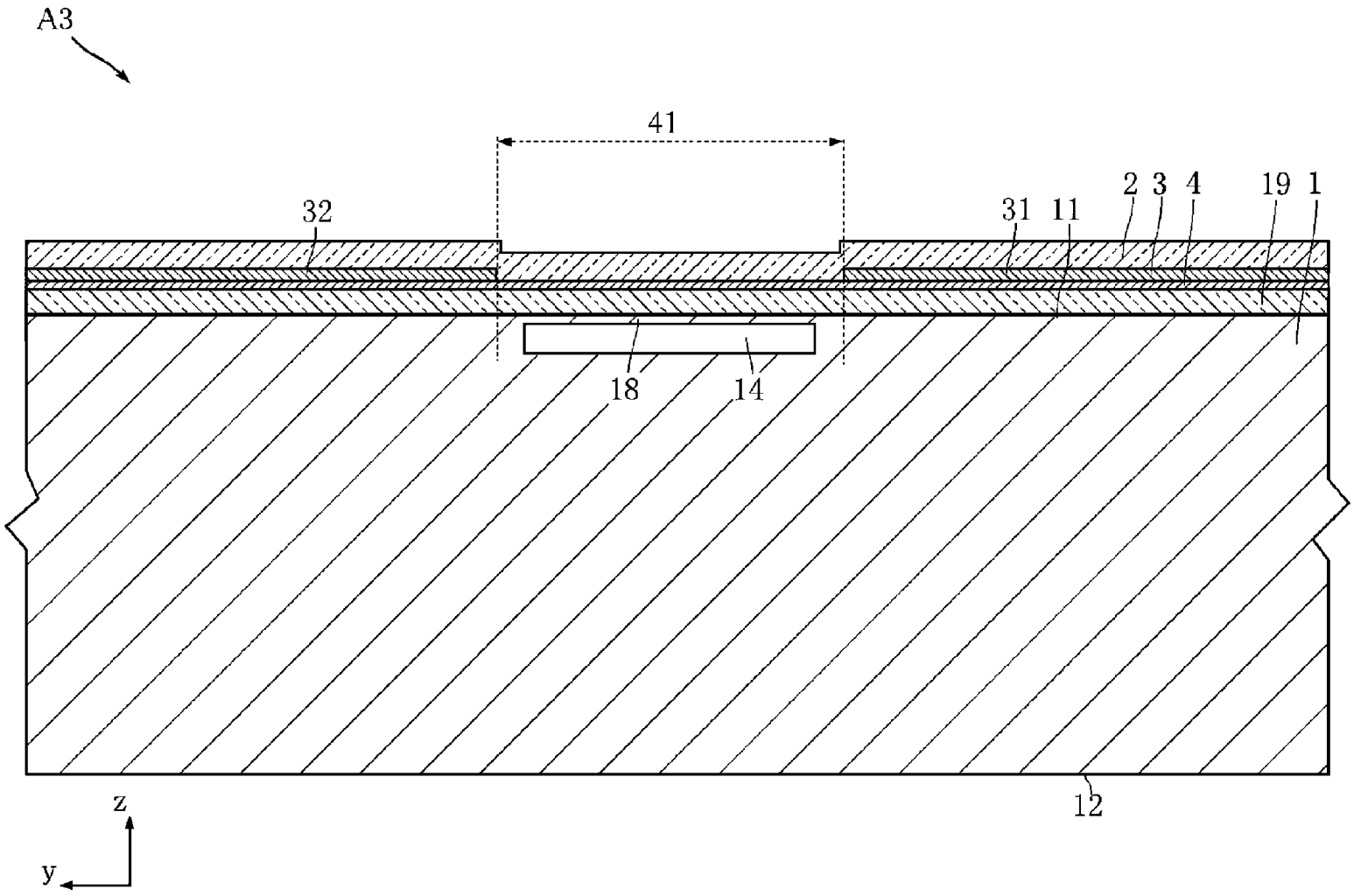
FIG. 21 is an enlarged main part cross-sectional view showing a thermal print head according to a third embodiment of the present disclosure.

FIG. 21 is an enlarged main part cross-sectional view showing a thermal print head according to a third embodiment of the present disclosure. A thermal print head A3 of the third embodiment is different from the thermal print head A1 of the first embodiment in that a convex portion 13 is not formed on the first substrate 1. The entire surface of an upper side of the first substrate 1 in the thickness direction z corresponds to the first main surface 11.

Also in the thermal print head A3, the cavity portion 14 is formed at a position overlapping the heat generating portions 41 in the thickness direction z. Further, in the shown example, the dimension of the cavity portion 14 in the sub-scanning direction y is smaller than the dimension of the heat generating portion 41 in the sub-scanning direction y.

According to the third embodiment, the printing quality can be improved by suppressing excessive heat transfer. Further, as can be understood from the third embodiment, the first substrate 1 may have a flat shape as a whole without the convex portion 13.

First Modification of Third Embodiment

Figure 22:
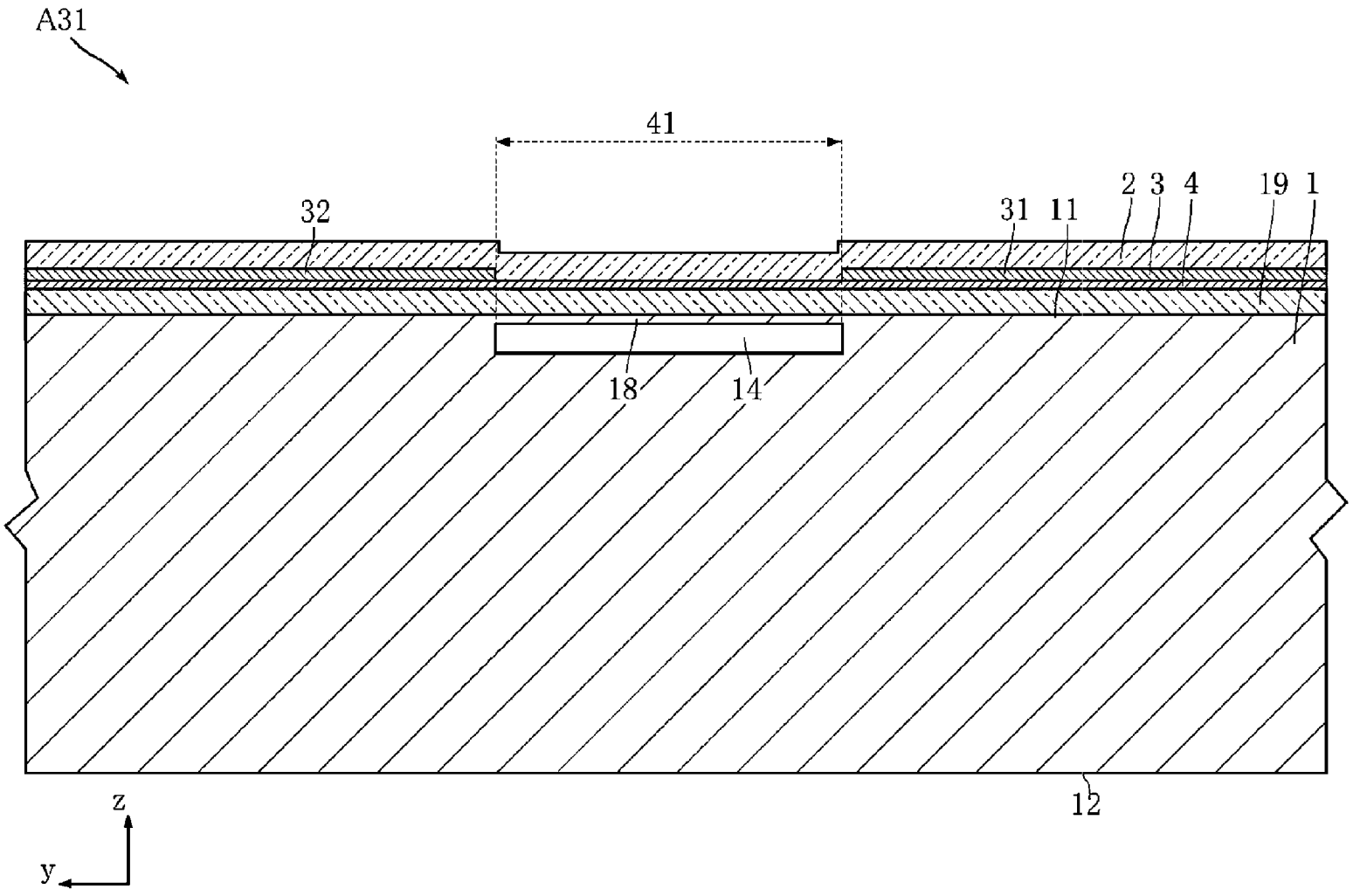
FIG. 22 is an enlarged main part cross-sectional view showing a first modification of the thermal print head according to the third embodiment of the present disclosure.

FIG. 22 is an enlarged main part cross-sectional view showing a first modification of the thermal print head A3. In the thermal print head A31 of the first modification, the dimension of the cavity portion 14 in the sub-scanning direction y is the same as the dimension of the heat generating portion 41 in the sub-scanning direction y. When viewed in the thickness direction z, the edge of the heat generating portion 41 in the sub-scanning direction y and the edge of the cavity portion 14 in the sub-scanning direction y substantially coincide with each other.

According to the first modification of the third embodiment, the printing quality can be improved by suppressing excessive heat transfer. Further, as can be understood from the first modification of the third embodiment, the dimension of the cavity portion 14 in the sub-scanning direction y may be set as appropriate.

Second Modification of Third Embodiment

Figure 23:
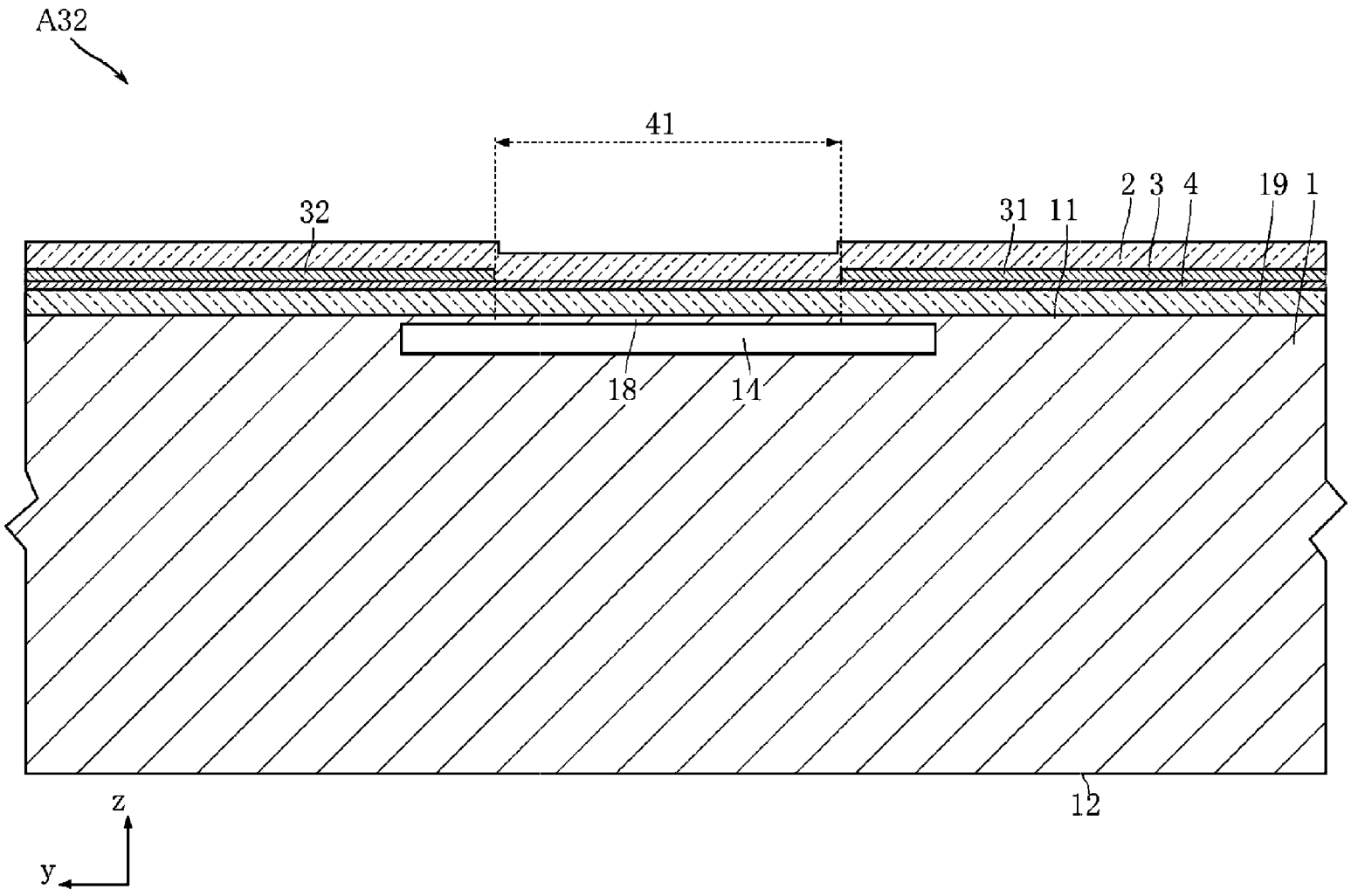
FIG. 23 is an enlarged main part cross-sectional view showing a second modification of the thermal print head according to the third embodiment of the present disclosure.

FIG. 23 is an enlarged main part cross-sectional view showing a second modification of the thermal print head A3. In the thermal print head A32 of the second modification, the dimension of the cavity portion 14 in the sub-scanning direction y is larger than the dimension of the heat generating portion 41 in the sub-scanning direction y. When viewed in the thickness direction z, the cavity portion 14 extends from the heat generating portion 41 in the sub-scanning direction y.

According to the second modification of the third embodiment, the printing energy efficiency and the printing quality can be improved by suppressing excessive heat transfer. Further, as can be understood from the second modification of the third embodiment, the dimension of the cavity portion 14 in the sub-scanning direction y may be set as appropriate.

The thermal print head and the thermal print head manufacturing method according to the present disclosure are not limited to the above-described embodiments. The specific configurations of the thermal print head and the thermal print head manufacturing method according to the present disclosure may be variously changed in design.

[Supplementary Note 1]

A thermal print head including:

a substrate;

a resistor layer supported by the substrate and including a plurality of heat generating portions arranged in a main scanning direction;

a wiring layer supported by the substrate and forming an energizing path to the plurality of heat generating portions; and an insulating layer interposed between the substrate and the resistor layer, wherein the substrate has a cavity portion overlapping the plurality of heat generating portions when viewed in a thickness direction of the substrate.

[Supplementary Note 2]

The thermal print head of Supplementary Note 1, wherein the substrate is made of a single crystal semiconductor.

[Supplementary Note 3]

The thermal print head of Supplementary Note 2, wherein the substrate is made of Si.

[Supplementary Note 4]

The thermal print head of one of Supplementary Notes 1 to 3, wherein the substrate includes a main surface on which the insulating layer is formed, and a convex portion protruding from the main surface and extending in the main scanning direction, and wherein the convex portion includes a top portion having the largest distance from the main surface, and at least one first inclined portion connected to the top portion in a sub-scanning direction and inclined with respect to the main surface.

[Supplementary Note 5]

The thermal print head of Supplementary Note 4, wherein the heat generating portions are formed on at least a part of the top portion in the sub-scanning direction and at least a part of the at least one first inclined portion in the sub-scanning direction across boundaries between the top portion and the at least one first inclined portion.

[Supplementary Note 6]

The thermal print head of Supplementary Note 5, wherein the at least one first inclined portion includes a pair of first inclined portions located on both sides in the sub-scanning direction with the top portion interposed between the pair of first inclined portions.

[Supplementary Note 7]

The thermal print head of Supplementary Note 6, wherein the convex portion includes a pair of second inclined portions located on both sides in the sub-scanning direction with the pair of first inclined portions interposed between the pair of second inclined portions.

[Supplementary Note 8]

The thermal print head of Supplementary Note 7, wherein the heat generating portions are further formed on at least a part of the pair of second inclined portions in the sub-scanning direction across boundaries between the pair of first inclined portions and the pair of second inclined portions.

[Supplementary Note 9]

The thermal print head of one of Supplementary Notes 4 to 8, wherein a size of the cavity portion in the sub-scanning direction is smaller than sizes of the heat generating portions in the sub-scanning direction.

[Supplementary Note 10]

The thermal print head of Supplementary Note 9, wherein the size of the cavity portion in the sub-scanning direction is smaller than a size of the top portion in the sub-scanning direction.

[Supplementary Note 11]

The thermal print head of one of Supplementary Notes 4 to 10, wherein the cavity portion overlaps the at least one first inclined portion when viewed in the sub-scanning direction.

[Supplementary Note 12]

The thermal print head of one of Supplementary Notes 1 to 3, wherein a size of the cavity portion in a sub-scanning direction is smaller than sizes of the heat generating portions in the sub-scanning direction.

[Supplementary Note 13]

The thermal print head of one of Supplementary Notes 1 to 3, wherein a size of the cavity portion in a sub-scanning direction is the same as sizes of the heat generating portions in the sub-scanning direction.

[Supplementary Note 14]

The thermal print head of one of Supplementary Notes 1 to 13, further including a reflective layer that is located opposite the plurality of heat generating portions with respect to the insulating layer, overlaps the plurality of heat generating portions when viewed in a thickness direction of the plurality of heat generating portions, and has a thermal reflectance higher than that of the insulating layer.

[Supplementary Note 15]

The thermal print head of Supplementary Note 14, wherein the reflective layer contains Cu.

[Supplementary Note 16]

A method of manufacturing a thermal print head, including:

forming a plurality of holes recessed from a main surface in a substrate material made of a single crystal semiconductor;

forming a cavity portion in the substrate material;

forming an insulating layer covering the main surface;

forming a resistor layer on the insulating layer; and forming a wiring layer on the resistor layer, wherein the forming the cavity portion includes:

connecting bottom portions of the plurality of holes; and closing opening portions of the plurality of holes, and wherein a plurality of heat generating portions, which are portions of the resistor layer exposed from the wiring layer and are arranged in a main scanning direction, and the cavity portion overlap with each other when viewed in a thickness direction of the substrate material.

According to the present disclosure in some embodiments, it is possible to provide a thermal print head capable of improving print quality, and a method of manufacturing the thermal print head.

While certain embodiments have been described, these embodiments have been presented by way of example only, and are not intended to limit the scope of the disclosures. Indeed, the embodiments described herein may be embodied in a variety of other forms. Furthermore, various omissions, substitutions and changes in the form of the embodiments described herein may be made without departing from the spirit of the disclosures. The accompanying claims and their equivalents are intended to cover such forms or modifications as would fall within the scope and spirit of the disclosures.

What is claimed is:

1. A thermal print head comprising:

a substrate;

a resistor layer supported by the substrate and including a plurality of heat generating portions arranged in a main scanning direction;

a wiring layer supported by the substrate and forming an energizing path to the plurality of heat generating portions; and an insulating layer interposed between the substrate and the resistor layer, wherein the substrate has a plurality of cavity portions overlapping the plurality of heat generating portions when viewed in a thickness direction of the substrate, wherein the plurality of cavity portions is sealed by the substrate when viewed in the main scanning direction, and wherein the plurality of cavity portions is arranged in the thickness direction to respectively overlap each other when viewed in the thickness direction.

2. The thermal print head of claim 1, wherein the substrate is made of a single crystal semiconductor.

3. The thermal print head of claim 2, wherein the substrate is made of Si.

4. The thermal print head of claim 1, wherein the substrate includes a main surface on which the insulating layer is formed, and a convex portion protruding from the main surface and extending in the main scanning direction, and wherein the convex portion includes a top portion having the largest distance from the main surface, and at least one first inclined portion connected to the top portion in a sub-scanning direction and inclined with respect to the main surface.

5. The thermal print head of claim 4, wherein the heat generating portions are formed on at least a part of the top portion in the sub-scanning direction and at least a part of the at least one first inclined portion in the sub-scanning direction across boundaries between the top portion and the at least one first inclined portion.

6. The thermal print head of claim 5, wherein the at least one first inclined portion includes a pair of first inclined portions located on both sides in the sub-scanning direction with the top portion interposed between the pair of first inclined portions.

7. The thermal print head of claim 6, wherein the convex portion includes a pair of second inclined portions located on both sides in the sub-scanning direction with the pair of first inclined portions interposed between the pair of second inclined portions.

8. The thermal print head of claim 7, wherein the heat generating portions are further formed on at least a part of the pair of second inclined portions in the sub-scanning direction across boundaries between the pair of first inclined portions and the pair of second inclined portions.

9. The thermal print head of claim 4, wherein a size of each of the plurality of cavity portions in the sub-scanning direction is smaller than sizes of the heat generating portions in the sub-scanning direction.

10. The thermal print head of claim 9, wherein the size of each of the plurality of cavity portions in the sub-scanning direction is smaller than a size of the top portion in the sub-scanning direction.

11. The thermal print head of claim 4, wherein the plurality of cavity portions overlap the at least one first inclined portion when viewed in the sub-scanning direction.

12. The thermal print head of claim 1, wherein a size of each of the plurality of cavity portions in a sub-scanning direction is smaller than sizes of the heat generating portions in the sub-scanning direction.

13. The thermal print head of claim 1, wherein a size of each of the plurality of cavity portions in a sub-scanning direction is the same as sizes of the heat generating portions in the sub-scanning direction.

14. The thermal print head of claim 1, further comprising a reflective layer that is located opposite the plurality of heat generating portions with respect to the insulating layer, overlaps the plurality of heat generating portions when viewed in a thickness direction of the plurality of heat generating portions, and has a thermal reflectance higher than that of the insulating layer.

15. The thermal print head of claim 14, wherein the reflective layer contains Cu.

16. A method of manufacturing a thermal print head, comprising: forming a plurality of holes recessed from a main surface in a substrate material made of a single crystal semiconductor;

forming a plurality of cavity portions in the substrate material;

forming an insulating layer covering the main surface;

forming a resistor layer on the insulating layer; and forming a wiring layer on the resistor layer, wherein the forming the plurality of cavity portions includes:

connecting bottom portions of the plurality of holes; and closing opening portions of the plurality of holes, wherein a plurality of heat generating portions, which are portions of the resistor layer exposed from the wiring layer and are arranged in a main scanning direction, and the plurality of cavity portions overlap with each other when viewed in a thickness direction of the substrate material, wherein the plurality of cavity portions is sealed by the substrate material when viewed in the main scanning direction, and wherein the plurality of cavity portions is formed to be arranged in the thickness direction to respectively overlap each other when viewed in the thickness direction.

* * * * *